US012687314B2

(12) United States Patent
Gupta et al.

(10) Patent No.: US 12,687,314 B2
(45) Date of Patent: Jul. 21, 2026

(54) METHOD AND SYSTEM FOR CONTROLLING A FRESH AIR INTAKE OF AN AIR HANDLING UNIT OF AN HVAC SYSTEM

(71) Applicant: Honeywell International Inc., Charlotte, NC (US)

(72) Inventors: Vishwanath Gupta, Ranchi (IN); Kanchan Aggarwal, Karnatka (IN); Deepika Sandeep, Bangalore (IN); Rohil Pal, Kanpur (IN); Madhav Kamath, Karnataka (IN); Bhavesh S. Gupta, Cumming, GA (US); Prabhat Ranjan, Bangalore (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 527 days.

(21) Appl. No.: 18/319,447

(22) Filed: May 17, 2023

(65) Prior Publication Data

US 2024/0384887 A1 Nov. 21, 2024

(51) Int. Cl.
*F24F 11/63* (2018.01)
*F24F 140/40* (2018.01)

(52) U.S. Cl.
CPC ..... *F24F 11/63* (2018.01); *F24F 2140/40* (2018.01)

(58) Field of Classification Search
CPC ..... F24F 2140/40
See application file for complete search history.

(56) References Cited

U.S. PATENT DOCUMENTS 191,512 A 6/1877 Bennett et al.
4,009,647 A 3/1977 Howorth
(Continued)

FOREIGN PATENT DOCUMENTS

CA 2387100 A1 11/2003
CA 2538139 A1 3/2005
(Continued)

OTHER PUBLICATIONS

Olken et al., "Object Lessons Learned from a Distributed System for Remote Building Monitoring and Operation," ACM SIGPLAN Notices, vol. 33, No. 10, pp. 284-295, Oct. 1998.
(Continued)

*Primary Examiner* — Nathan L Laughlin
(74) *Attorney, Agent, or Firm* — Seager, Tufte & Wickhem, LLP

(57) ABSTRACT

Controlling a fresh air intake includes determining a fresh air intake damper position based on the supply air flowrate, a measure of energy delivered to the supply air flow, or a measure of humidity of the supply air flow. Determining the fresh air intake damper position is subject to a constraint that the AHU maintains one or more comfort conditions in the building space and one or more of a constraint regarding maintaining one or more Indoor Air Quality (IAQ) contaminants in the building space below one or more IAQ thresholds, minimizing energy consumption of the AHU, and maximizing the fresh air ventilation air flow into the building space. Various parameters used to determine the fresh air intake damper position may be derived from available sensed conditions so as to reduce the number of physical sensors that are required.

20 Claims, 8 Drawing Sheets

(56) References Cited

U.S. PATENT DOCUMENTS 4,375,637 A 3/1983 Desjardins
4,918,615 A 4/1990 Suzuki et al.
4,939,922 A 7/1990 Smalley et al.
5,566,084 A 10/1996 Cmar
5,727,579 A 3/1998 Chardack
5,745,126 A 4/1998 Jain et al.
5,751,916 A 5/1998 Kon et al.
5,777,598 A 7/1998 Gowda et al.
5,973,662 A 10/1999 Singers et al.
6,065,842 A 5/2000 Fink
6,139,177 A 10/2000 Venkatraman et al.
6,144,993 A 11/2000 Fukunaga et al.
6,157,943 A 12/2000 Meyer
6,229,429 B1 5/2001 Horon
6,238,337 B1 5/2001 Kambhatla et al.
6,334,211 B1 12/2001 Kojima et al.
6,353,853 B1 3/2002 Gravlin
6,369,695 B2 4/2002 Horon
6,375,038 B1 4/2002 Daansen et al.
6,415,617 B1 7/2002 Seem
6,429,868 B1 8/2002 Dehner, Jr. et al.
6,473,084 B1 10/2002 Phillips et al.
6,487,457 B1 11/2002 Hull et al.
6,580,950 B1 6/2003 Johnson et al.
6,598,056 B1 7/2003 Hull et al.
6,619,555 B2 9/2003 Rosen
6,704,012 B1 3/2004 Lefave
6,720,874 B2 4/2004 Fufido et al.
6,741,915 B2 5/2004 Poth
6,796,896 B2 9/2004 Laiti
6,801,199 B1 10/2004 Wallman
6,816,878 B1 11/2004 Zimmers et al.
6,876,951 B2 4/2005 Skidmore et al.
6,882,278 B2 4/2005 Winings et al.
6,904,385 B1 6/2005 Budike, Jr.
6,907,387 B1 6/2005 Reardon
6,911,177 B2 6/2005 Deal
6,993,403 B1 1/2006 Dadebo et al.
6,993,417 B2 1/2006 Osann, Jr.
7,023,440 B1 4/2006 Havekost et al.
7,031,880 B1 4/2006 Seem et al.
7,062,722 B1 6/2006 Carlin et al.
7,110,843 B2 9/2006 Pagnano et al.
7,139,685 B2 11/2006 Bascle et al.
7,164,972 B2 1/2007 Imhof et al.
7,183,899 B2 2/2007 Behnke
7,200,639 B1 4/2007 Yoshida
7,222,111 B1 5/2007 Budike, Jr.
7,222,800 B2 5/2007 Wruck
7,257,397 B2 8/2007 Shamoon et al.
7,280,030 B1 10/2007 Monaco
7,292,908 B2 11/2007 Borne et al.
7,295,116 B2 11/2007 Kumar et al.
7,302,313 B2 11/2007 Sharp et al.
7,308,323 B2 12/2007 Kruk et al.
7,308,388 B2 12/2007 Beverina et al.
7,313,447 B2 12/2007 Hsiung et al.
7,346,433 B2 3/2008 Budike, Jr.
7,356,548 B1 4/2008 Culp et al.
7,379,782 B1 5/2008 Cocco
7,383,148 B2 6/2008 Ahmed
7,434,742 B2 10/2008 Mueller et al.
7,447,333 B1 11/2008 Masticola et al.
7,466,224 B2 12/2008 Ward et al.
7,496,472 B2 2/2009 Seem
7,512,450 B2 3/2009 Ahmed
7,516,490 B2 4/2009 Riordan et al.
7,548,833 B2 6/2009 Ahmed
7,551,092 B1 6/2009 Henry
7,557,729 B2 7/2009 Hubbard et al.
7,567,844 B2 7/2009 Thomas et al.
7,596,473 B2 9/2009 Hansen et al.
7,610,910 B2 11/2009 Ahmed
7,626,507 B2 12/2009 LaCasse
7,664,574 B2 2/2010 Imhof et al.
7,682,464 B2 3/2010 Glenn et al.
7,702,421 B2 4/2010 Sullivan et al.
7,729,882 B2 6/2010 Seem
7,755,494 B2 7/2010 Melker et al.
7,761,310 B2 7/2010 Rodgers
7,774,227 B2 8/2010 Srivastava
7,797,188 B2 9/2010 Srivastava
7,819,136 B1 10/2010 Eddy
7,822,806 B2 10/2010 Frank et al.
7,856,370 B2 12/2010 Katta et al.
7,978,083 B2 7/2011 Melker et al.
7,984,384 B2 7/2011 Chaudhri et al.
7,986,323 B2 7/2011 Kobayashi et al.
8,024,666 B2 9/2011 Thompson
8,086,047 B2 12/2011 Penke et al.
8,099,178 B2 1/2012 Mairs et al.
8,151,280 B2 4/2012 Sather et al.
8,176,095 B2 5/2012 Murray et al.
8,218,871 B2 7/2012 Angell et al.
8,219,660 B2 7/2012 McCoy et al.
8,271,941 B2 9/2012 Zhang et al.
8,294,585 B2 10/2012 Barnhill
8,302,020 B2 10/2012 Ouch et al.
8,320,634 B2 11/2012 Deutsch
8,334,422 B2 12/2012 Gutsol et al.
8,344,893 B1 1/2013 Drammeh
8,375,118 B2 2/2013 Hao et al.
8,473,080 B2 6/2013 Seem et al.
8,476,590 B2 7/2013 Stratmann et al.
8,516,016 B2 8/2013 Park et al.
8,558,660 B2 10/2013 Nix et al.
8,639,527 B2 1/2014 Rensvold et al.
8,698,637 B2 4/2014 Raichman
8,816,860 B2 8/2014 Ophardt et al.
8,869,027 B2 10/2014 Louch et al.
8,878,426 B2 11/2014 Sakakura et al.
8,904,497 B2 12/2014 Hsieh
8,936,944 B2 1/2015 Peltz et al.
8,947,437 B2 2/2015 Garr et al.
8,950,019 B2 2/2015 Loberger et al.
9,000,926 B2 4/2015 Hollock et al.
9,002,532 B2 4/2015 Asmus
9,030,325 B2 5/2015 Taneff
9,098,738 B2 8/2015 Bilet et al.
9,105,071 B2 8/2015 Fletcher et al.
9,175,356 B2 11/2015 Peltz et al.
9,235,657 B1 1/2016 Wenzel et al.
9,240,111 B2 1/2016 Scott et al.
9,256,702 B2 2/2016 Elbsat et al.
9,280,884 B1 3/2016 Schultz et al.
9,292,972 B2 3/2016 Hailemariam et al.
9,311,807 B2 4/2016 Schultz et al.
9,320,662 B2 4/2016 Hayes et al.
9,322,566 B2 4/2016 Wenzel et al.
9,355,069 B2 5/2016 Elbsat et al.
9,370,600 B1 6/2016 DuPuis et al.
9,373,242 B1 6/2016 Conrad et al.
9,396,638 B2 7/2016 Wildman et al.
9,406,212 B2 8/2016 De Luca et al.
9,418,535 B1 8/2016 Felch et al.
9,418,536 B1 8/2016 Felch et al.
9,436,179 B1 9/2016 Turney et al.
9,447,985 B2 9/2016 Johnson, Jr.
9,449,219 B2 9/2016 Bilet et al.
9,477,543 B2 10/2016 Henley et al.
9,497,832 B2 11/2016 Verberkt et al.
9,513,364 B2 12/2016 Hall et al.
9,526,380 B2 12/2016 Hamilton et al.
9,526,806 B2 12/2016 Park et al.
9,536,415 B2 1/2017 De Luca et al.
9,558,648 B2 1/2017 Douglas
9,568,204 B2 2/2017 Asmus et al.
9,581,985 B2 2/2017 Walser et al.
9,591,267 B2 3/2017 Lipton et al.
9,606,520 B2 3/2017 Noboa et al.
9,612,601 B2 4/2017 Beyhaghi et al.
9,613,518 B2 4/2017 Dunn et al.
9,618,224 B2 4/2017 Emmons et al.
9,640,059 B2 5/2017 Hyland

(56) References Cited

U.S. PATENT DOCUMENTS

| | | | |
|---|---|---|---|
| 9,672,360 | B2 | 6/2017 | Barkan |
| 9,696,054 | B2 | 7/2017 | Asmus |
| 9,710,700 | B2 | 7/2017 | Bilet et al. |
| 9,715,242 | B2 | 7/2017 | Pillai et al. |
| 9,721,452 | B2 | 8/2017 | Felch et al. |
| 9,729,945 | B2 | 8/2017 | Schultz et al. |
| 9,778,639 | B2 | 10/2017 | Boettcher et al. |
| 9,784,464 | B2 | 10/2017 | Yamamoto et al. |
| 9,798,336 | B2 | 10/2017 | Przybylski |
| 9,810,442 | B2 | 11/2017 | Matsuoka et al. |
| 9,843,743 | B2 | 12/2017 | Lewis et al. |
| 9,852,481 | B1 | 12/2017 | Turney et al. |
| 9,856,634 | B2 | 1/2018 | Rodenbeck et al. |
| 9,872,088 | B2 | 1/2018 | Fadell et al. |
| 9,875,639 | B2 | 1/2018 | Bone et al. |
| 9,897,338 | B2 | 2/2018 | Fan et al. |
| 9,911,312 | B2 | 3/2018 | Wildman et al. |
| 9,940,819 | B2 | 4/2018 | Ferniany |
| 9,956,306 | B2 | 5/2018 | Brais et al. |
| 9,982,903 | B1 | 5/2018 | Ridder et al. |
| 9,986,175 | B2 | 5/2018 | Frank et al. |
| 10,007,259 | B2 | 6/2018 | Turney et al. |
| 10,031,494 | B2 | 7/2018 | Holaso |
| 10,055,114 | B2 | 8/2018 | Shah et al. |
| 10,087,608 | B2 | 10/2018 | Dobizl et al. |
| 10,101,730 | B2 | 10/2018 | Wenzel et al. |
| 10,101,731 | B2 | 10/2018 | Asmus et al. |
| 10,175,681 | B2 | 1/2019 | Wenzel et al. |
| 10,222,083 | B2 | 3/2019 | Drees et al. |
| 10,223,894 | B2 | 3/2019 | Raichman |
| 10,228,837 | B2 | 3/2019 | Hua et al. |
| 10,235,865 | B2 | 3/2019 | Thyroff |
| 10,251,610 | B2 | 4/2019 | Parthasarathy et al. |
| 10,282,796 | B2 | 5/2019 | Elbsat et al. |
| 10,288,306 | B2 | 5/2019 | Ridder et al. |
| 10,303,843 | B2 | 5/2019 | Bitran et al. |
| 10,317,864 | B2 | 6/2019 | Boettcher et al. |
| 10,332,043 | B2 | 6/2019 | Nair et al. |
| 10,332,382 | B2 | 6/2019 | Thyroff |
| 10,359,748 | B2 | 7/2019 | Elbsat et al. |
| 10,386,820 | B2 | 8/2019 | Wenzel et al. |
| 10,402,767 | B2 | 9/2019 | Noboa et al. |
| 10,488,068 | B2 | 11/2019 | Danielson |
| 10,514,178 | B2 | 12/2019 | Willmott et al. |
| 10,514,817 | B2 | 12/2019 | Hua et al. |
| 10,520,210 | B2 | 12/2019 | Park et al. |
| 10,544,955 | B2 | 1/2020 | Przybylski |
| 10,558,178 | B2 | 2/2020 | Willmott et al. |
| 10,559,180 | B2 | 2/2020 | Pourmohammad et al. |
| 10,559,181 | B2 | 2/2020 | Pourmohammad et al. |
| 10,565,844 | B2 | 2/2020 | Pourmohammad et al. |
| 10,600,263 | B2 | 3/2020 | Park et al. |
| 10,602,474 | B2 | 3/2020 | Goldstein |
| 10,605,477 | B2 | 3/2020 | Ridder |
| 10,607,147 | B2 | 3/2020 | Raykov et al. |
| 10,619,882 | B2 | 4/2020 | Chatterjee et al. |
| 10,627,124 | B2 | 4/2020 | Walser et al. |
| 10,673,380 | B2 | 6/2020 | Wenzel et al. |
| 10,678,227 | B2 | 6/2020 | Przybylski et al. |
| 10,706,375 | B2 | 7/2020 | Wenzel et al. |
| 10,726,711 | B2 | 7/2020 | Subramanian et al. |
| 10,731,885 | B2 | 8/2020 | Ajax et al. |
| 10,732,584 | B2 | 8/2020 | Elbsat et al. |
| 10,767,885 | B2 | 9/2020 | Przybylski et al. |
| 10,775,988 | B2 | 9/2020 | Narain et al. |
| 10,796,554 | B2 | 10/2020 | Vincent et al. |
| 10,809,682 | B2 | 10/2020 | Patil et al. |
| 10,809,705 | B2 | 10/2020 | Przybylski |
| 10,824,125 | B2 | 11/2020 | Elbsat et al. |
| 10,854,194 | B2 | 12/2020 | Park et al. |
| 10,871,298 | B2 | 12/2020 | Ridder et al. |
| 10,871,756 | B2 | 12/2020 | Johnson, Jr. et al. |
| 10,876,754 | B2 | 12/2020 | Wenzel et al. |
| 10,890,904 | B2 | 1/2021 | Turney et al. |
| 10,900,686 | B2 | 1/2021 | Willmott et al. |
| 10,901,446 | B2 | 1/2021 | Nesler et al. |
| 10,908,578 | B2 | 2/2021 | Johnson, Jr. et al. |
| 10,909,642 | B2 | 2/2021 | Elbsat et al. |
| 10,915,094 | B2 | 2/2021 | Wenzel et al. |
| 10,917,740 | B1 | 2/2021 | Scott et al. |
| 10,921,768 | B2 | 2/2021 | Johnson, Jr. et al. |
| 10,921,972 | B2 | 2/2021 | Park et al. |
| 10,921,973 | B2 | 2/2021 | Park et al. |
| 10,928,084 | B2 | 2/2021 | Ajax et al. |
| 10,928,790 | B2 | 2/2021 | Mueller et al. |
| 10,948,884 | B2 | 3/2021 | Beaty et al. |
| 10,949,777 | B2 | 3/2021 | Elbsat et al. |
| 10,955,800 | B2 | 3/2021 | Burroughs et al. |
| 10,956,842 | B2 | 3/2021 | Wenzel et al. |
| 10,962,945 | B2 | 3/2021 | Park et al. |
| 10,969,135 | B2 | 4/2021 | Willmott et al. |
| 11,002,457 | B2 | 5/2021 | Turney et al. |
| 11,009,252 | B2 | 5/2021 | Turney et al. |
| 11,010,846 | B2 | 5/2021 | Elbsat et al. |
| 11,016,648 | B2 | 5/2021 | Fala et al. |
| 11,016,998 | B2 | 5/2021 | Park et al. |
| 11,022,947 | B2 | 6/2021 | Elbsat et al. |
| 11,024,292 | B2 | 6/2021 | Park et al. |
| 11,036,249 | B2 | 6/2021 | Elbsat |
| 11,038,709 | B2 | 6/2021 | Park et al. |
| 11,042,139 | B2 | 6/2021 | Deshpande et al. |
| 11,042,924 | B2 | 6/2021 | Asmus et al. |
| 11,061,424 | B2 | 7/2021 | Elbsat et al. |
| 11,068,821 | B2 | 7/2021 | Wenzel et al. |
| 11,070,389 | B2 | 7/2021 | Schuster et al. |
| 11,073,976 | B2 | 7/2021 | Park et al. |
| 11,080,289 | B2 | 8/2021 | Park et al. |
| 11,080,426 | B2 | 8/2021 | Park et al. |
| 11,086,276 | B2 | 8/2021 | Wenzel et al. |
| 11,094,186 | B2 | 8/2021 | Razak |
| 11,108,587 | B2 | 8/2021 | Park et al. |
| 11,113,295 | B2 | 9/2021 | Park et al. |
| 11,119,458 | B2 | 9/2021 | Asp et al. |
| 11,120,012 | B2 | 9/2021 | Park et al. |
| 11,131,473 | B2 | 9/2021 | Risbeck et al. |
| 11,150,617 | B2 | 10/2021 | Ploegert et al. |
| 11,151,983 | B2 | 10/2021 | Park et al. |
| 11,156,978 | B2 | 10/2021 | Johnson, Jr. et al. |
| 11,156,996 | B2 | 10/2021 | Schuster et al. |
| 11,158,306 | B2 | 10/2021 | Park et al. |
| 11,181,289 | B2 | 11/2021 | Federspiel et al. |
| 11,182,047 | B2 | 11/2021 | Nayak et al. |
| 11,195,401 | B2 | 12/2021 | Pourmohammad |
| 11,209,177 | B2 | 12/2021 | Ito et al. |
| 11,217,087 | B2 | 1/2022 | Pelski |
| 11,226,126 | B2 | 1/2022 | Przybylski et al. |
| 11,243,523 | B2 | 2/2022 | Llopis et al. |
| 11,268,715 | B2 | 3/2022 | Park et al. |
| 11,268,996 | B2 | 3/2022 | Vitullo et al. |
| 11,269,303 | B2 | 3/2022 | Wenzel et al. |
| 11,269,306 | B2 | 3/2022 | Risbeck et al. |
| 11,269,505 | B2 | 3/2022 | Fala et al. |
| 11,272,011 | B1 | 3/2022 | Laughton et al. |
| 11,272,316 | B2 | 3/2022 | Scott et al. |
| 11,275,348 | B2 | 3/2022 | Park et al. |
| 11,275,363 | B2 | 3/2022 | Przybylski et al. |
| 11,281,169 | B2 | 3/2022 | Chatterjee et al. |
| 11,288,754 | B2 | 3/2022 | Elbsat et al. |
| 11,314,726 | B2 | 4/2022 | Park et al. |
| 11,314,788 | B2 | 4/2022 | Park et al. |
| 11,334,044 | B2 | 5/2022 | Goyal |
| 11,353,834 | B2 | 6/2022 | Mueller et al. |
| 11,356,292 | B2 | 6/2022 | Ploegert et al. |
| 11,360,451 | B2 | 6/2022 | Pancholi et al. |
| 11,361,123 | B2 | 6/2022 | Ploegert et al. |
| 11,888,093 | B2 | 1/2024 | Zhang et al. |
| 2002/0111698 | A1 | 8/2002 | Graziano et al. |
| 2002/0130868 | A1 | 9/2002 | Smith |
| 2003/0028269 | A1 | 2/2003 | Spriggs et al. |
| 2003/0030637 | A1 | 2/2003 | Grinstein et al. |
| 2003/0046862 | A1 | 3/2003 | Wolf et al. |
| 2003/0071814 | A1 | 4/2003 | Jou et al. |
| 2003/0078677 | A1 | 4/2003 | Hull et al. |
| 2003/0083957 | A1 | 5/2003 | Olefson |

(56) References Cited

U.S. PATENT DOCUMENTS

2003/0103075 A1 6/2003 Rosselot
2003/0171851 A1 9/2003 Brickfield et al.
2003/0214400 A1 11/2003 Mizutani et al.
2003/0233432 A1 12/2003 Davis et al.
2004/0001009 A1 1/2004 Winings et al.
2004/0064260 A1 4/2004 Padmanabhan et al.
2004/0143474 A1 7/2004 Haeberle et al.
2004/0153437 A1 8/2004 Buchan
2004/0168115 A1 8/2004 Bauernschmidt et al.
2004/0233192 A1 11/2004 Hopper
2004/0260411 A1 12/2004 Cannon
2004/0262410 A1 12/2004 Hull
2005/0010460 A1 1/2005 Mizoguchi et al.
2005/0119767 A1 6/2005 Kiwimagi et al.
2005/0143863 A1 6/2005 Ruane et al.
2005/0267900 A1 12/2005 Ahmed et al.
2006/0004841 A1 1/2006 Heikkonen et al.
2006/0009862 A1 1/2006 Imhof et al.
2006/0017547 A1 1/2006 Buckingham et al.
2006/0020177 A1 1/2006 Seo et al.
2006/0028471 A1 2/2006 Kincaid et al.
2006/0029256 A1 2/2006 Miyoshi et al.
2006/0058900 A1 3/2006 Johanson et al.
2006/0067545 A1 3/2006 Lewis et al.
2006/0067546 A1 3/2006 Lewis et al.
2006/0077255 A1 4/2006 Cheng
2006/0184326 A1 8/2006 McNally et al.
2006/0231568 A1 10/2006 Lynn et al.
2006/0265664 A1 11/2006 Simons et al.
2006/0279630 A1 12/2006 Aggarwal et al.
2007/0016955 A1 1/2007 Goldberg et al.
2007/0055757 A1 3/2007 Mairs et al.
2007/0055760 A1 3/2007 McCoy et al.
2007/0061046 A1 3/2007 Mairs et al.
2007/0067062 A1 3/2007 Mairs et al.
2007/0088534 A1 4/2007 MacArthur et al.
2007/0090951 A1 4/2007 Chan et al.
2007/0091091 A1 4/2007 Gardiner et al.
2007/0101433 A1 5/2007 Louch et al.
2007/0114295 A1 5/2007 Jenkins
2007/0120652 A1 5/2007 Behnke
2007/0139208 A1 6/2007 Kates
2007/0216682 A1 9/2007 Navratil et al.
2007/0219645 A1 9/2007 Thomas et al.
2007/0239484 A1 10/2007 Arond et al.
2007/0268122 A1 11/2007 Kow et al.
2008/0001763 A1 1/2008 Raja et al.
2008/0027885 A1 1/2008 Van Putten et al.
2008/0036593 A1 2/2008 Rose-Pehrsson et al.
2008/0062167 A1 3/2008 Boggs et al.
2008/0099045 A1 5/2008 Glenn et al.
2008/0103798 A1 5/2008 Domenikos et al.
2008/0120396 A1 5/2008 Jayaram et al.
2008/0144885 A1 6/2008 Zucherman et al.
2008/0183424 A1 7/2008 Seem
2008/0194009 A1 8/2008 Marentis
2008/0198231 A1 8/2008 Ozdemir et al.
2008/0209342 A1 8/2008 Taylor et al.
2008/0222565 A1 9/2008 Taylor et al.
2008/0224862 A1 9/2008 Cirker
2008/0242945 A1 10/2008 Gugliotti et al.
2008/0250800 A1 10/2008 Wetzel
2008/0279420 A1 11/2008 Masticola et al.
2008/0280275 A1 11/2008 Collopy
2008/0303658 A1 12/2008 Melker et al.
2008/0306985 A1 12/2008 Murray et al.
2008/0320552 A1 12/2008 Kumar et al.
2009/0001181 A1 1/2009 Siddaramanna et al.
2009/0024944 A1 1/2009 Louch et al.
2009/0065596 A1 3/2009 Seem et al.
2009/0083120 A1 3/2009 Strichman et al.
2009/0096791 A1 4/2009 Abshear et al.
2009/0125337 A1 5/2009 Abri
2009/0125825 A1 5/2009 Rye et al.
2009/0144023 A1 6/2009 Seem
2009/0157744 A1 6/2009 McConnell
2009/0160673 A1 6/2009 Cirker
2009/0322782 A1 12/2009 Kimchi et al.
2010/0048167 A1 2/2010 Chow et al.
2010/0058248 A1 3/2010 Park
2010/0064001 A1 3/2010 Daily
2010/0070089 A1 3/2010 Harrod et al.
2010/0073162 A1 3/2010 Johnson et al.
2010/0123560 A1 5/2010 Nix et al.
2010/0134296 A1 6/2010 Hwang
2010/0156628 A1 6/2010 Ainsbury et al.
2010/0156630 A1 6/2010 Ainsbury
2010/0188228 A1 7/2010 Hyland
2010/0223198 A1 9/2010 Noureldin et al.
2010/0249955 A1 9/2010 Sitton
2010/0286937 A1 11/2010 Hedley et al.
2010/0318200 A1 12/2010 Foslien et al.
2010/0324962 A1 12/2010 Nesler et al.
2011/0010654 A1 1/2011 Raymond et al.
2011/0057799 A1 3/2011 Taneff
2011/0077779 A1 3/2011 Fuller et al.
2011/0083094 A1 4/2011 Laycock et al.
2011/0087988 A1 4/2011 Ray et al.
2011/0112854 A1 5/2011 Koch et al.
2011/0126111 A1 5/2011 Gill et al.
2011/0154426 A1 6/2011 Doser et al.
2011/0161124 A1 6/2011 Lappinga et al.
2011/0169646 A1 7/2011 Raichman
2011/0184563 A1 7/2011 Foslien et al.
2011/0202467 A1 8/2011 Hilber et al.
2011/0273298 A1 11/2011 Snodgrass et al.
2011/0291841 A1 12/2011 Hollock et al.
2011/0298301 A1 12/2011 Wong et al.
2011/0316703 A1 12/2011 Butler et al.
2011/0320054 A1 12/2011 Brzezowski
2012/0022700 A1 1/2012 Drees et al.
2012/0039503 A1 2/2012 Chen et al.
2012/0062382 A1 3/2012 Taneff
2012/0075464 A1 3/2012 Derenne et al.
2012/0109988 A1 5/2012 Li et al.
2012/0112883 A1 5/2012 Wallace et al.
2012/0131217 A1 5/2012 Delorme et al.
2012/0158185 A1 6/2012 El-Mankabady et al.
2012/0216243 A1 8/2012 Gill et al.
2012/0224057 A1 9/2012 Gill et al.
2012/0232702 A1 9/2012 Vass et al.
2012/0259466 A1 10/2012 Ray et al.
2012/0262472 A1 10/2012 Garr et al.
2012/0272146 A1 10/2012 D'souza et al.
2012/0291068 A1 11/2012 Khushoo et al.
2012/0303652 A1 11/2012 Tseng
2012/0310418 A1 12/2012 Harrod et al.
2013/0030575 A1* 1/2013 Dempsey ..... F24F 11/74 700/276
2013/0055132 A1 2/2013 Foslien
2013/0060794 A1 3/2013 Puttabasappa et al.
2013/0082842 A1 4/2013 Balazs et al.
2013/0086152 A1 4/2013 Hersche et al.
2013/0091631 A1 4/2013 Hayes et al.
2013/0110295 A1 5/2013 Zheng et al.
2013/0144444 A1 6/2013 Ligeret
2013/0169681 A1 7/2013 Rasane et al.
2013/0184880 A1 7/2013 McMahon
2013/0187775 A1 7/2013 Marsden et al.
2013/0204570 A1 8/2013 Mendelson et al.
2013/0229276 A1 9/2013 Hunter
2013/0268293 A1 10/2013 Knudson et al.
2013/0289774 A1 10/2013 Day et al.
2014/0032157 A1 1/2014 Khiani
2014/0040998 A1 2/2014 Hsieh
2014/0046490 A1 2/2014 Foslien et al.
2014/0046722 A1 2/2014 Rosenbloom et al.
2014/0058539 A1 2/2014 Park
2014/0167917 A2 6/2014 Wallace et al.
2014/0207291 A1 7/2014 Golden et al.
2014/0292518 A1 10/2014 Wildman et al.
2014/0307076 A1 10/2014 Deutsch
2014/0309757 A1 10/2014 Le Sant et al.
2014/0316582 A1 10/2014 Berg-Sonne et al.

(56) References Cited

U.S. PATENT DOCUMENTS

2014/0320289 A1 10/2014 Raichman
2014/0324229 A1 10/2014 Leen et al.
2014/0342724 A1 11/2014 Hill et al.
2015/0025329 A1 1/2015 Amarasingham et al.
2015/0032264 A1 1/2015 Emmons et al.
2015/0056909 A1 2/2015 Chien
2015/0070174 A1 3/2015 Douglas
2015/0077258 A1 3/2015 Nelson et al.
2015/0107817 A1* 4/2015 Douglas ..... F24F 11/62 454/238
2015/0113462 A1 4/2015 Chen et al.
2015/0153918 A1 6/2015 Chen et al.
2015/0161874 A1 6/2015 Thyroff et al.
2015/0167995 A1 6/2015 Fadell et al.
2015/0168949 A1 6/2015 Hua et al.
2015/0194043 A1 7/2015 Dunn et al.
2015/0198707 A1 7/2015 Al-Alusi
2015/0212717 A1 7/2015 Nair et al.
2015/0213222 A1 7/2015 Amarasingham et al.
2015/0213379 A1 7/2015 Nair et al.
2015/0216369 A1 8/2015 Hamilton et al.
2015/0253748 A1 9/2015 Brun et al.
2015/0281287 A1 10/2015 Gill et al.
2016/0061473 A1 3/2016 Johnson, Jr.
2016/0061476 A1 3/2016 Schultz et al.
2016/0061477 A1 3/2016 Schultz et al.
2016/0061794 A1 3/2016 Schultz et al.
2016/0061795 A1 3/2016 Schultz et al.
2016/0063833 A1 3/2016 Schultz et al.
2016/0066067 A1 3/2016 Schultz et al.
2016/0116181 A1 4/2016 Aultman et al.
2016/0139067 A1 5/2016 Grace
2016/0253897 A1 9/2016 Wildman et al.
2016/0255516 A1 9/2016 Hill et al.
2016/0298864 A1 10/2016 Ekolind et al.
2016/0306934 A1 10/2016 Sperry et al.
2016/0314683 A1 10/2016 Felch et al.
2016/0328948 A1 11/2016 Ferniany
2016/0335731 A1 11/2016 Hall
2016/0367925 A1 12/2016 Blackley
2017/0024986 A1 1/2017 Austin
2017/0136848 A1* 5/2017 Trutnovsky ..... B60H 1/008
2017/0193792 A1 7/2017 Bermudez Rodriguez et al.
2017/0256155 A1 9/2017 Sengstaken, Jr.
2017/0280949 A1 10/2017 Wildman et al.
2017/0294106 A1 10/2017 Thyroff
2017/0343227 A1* 11/2017 Mowris ..... F24F 11/62
2017/0365024 A1 12/2017 Koch et al.
2018/0016773 A1 1/2018 Chandler et al.
2018/0151054 A1 5/2018 Pi
2018/0193501 A1 7/2018 Ufkes
2018/0218591 A1 8/2018 Easter
2018/0259927 A1 9/2018 Przybylski et al.
2018/0293038 A1 10/2018 Meruva et al.
2018/0301014 A1 10/2018 Worral et al.
2018/0313695 A1 11/2018 Shim et al.
2018/0365957 A1 12/2018 Wright et al.
2019/0051138 A1 2/2019 Easter
2019/0139395 A1 5/2019 Rogachev et al.
2019/0209719 A1 7/2019 Andersen et al.
2019/0302157 A1 10/2019 Vitullo et al.
2020/0009280 A1 1/2020 Kupa et al.
2020/0074836 A1 3/2020 Kolavennu et al.
2020/0090089 A1 3/2020 Aston et al.
2020/0146557 A1 5/2020 Cheung et al.
2020/0179544 A1 6/2020 Ufkes
2020/0188832 A1* 6/2020 Woods ..... B01D 46/58
2020/0200420 A1 6/2020 Nayak et al.
2020/0256571 A1 8/2020 Johnson, Jr. et al.
2021/0010701 A1 1/2021 Suindykov et al.
2021/0011443 A1 1/2021 Mcnamara et al.
2021/0011444 A1 1/2021 Risbeck et al.
2021/0018884 A1 1/2021 Kupa et al.
2021/0046205 A1 2/2021 Copeland, Jr. et al.
2021/0356927 A1 11/2021 Johnson, Jr. et al.
2021/0364181 A1 11/2021 Risbeck et al.
2021/0373519 A1 12/2021 Risbeck et al.
2022/0011731 A1 1/2022 Risbeck et al.
2022/0057244 A1 2/2022 Gonzaga et al.
2022/0113045 A1 4/2022 Gamroth et al.
2022/0113050 A1 4/2022 Douglas et al.
2022/0137580 A1 5/2022 Burroughs et al.
2022/0221184 A1 7/2022 Gupta et al.

FOREIGN PATENT DOCUMENTS

CN 103110410 A 5/2013
CN 103970977 A 8/2014
CN 105116848 A 12/2015
CN 108961714 A 12/2018
CN 110009245 A 7/2019
CN 110084928 A 8/2019
CN 110827457 A 2/2020
EP 1669912 A1 6/2006
EP 2310981 A1 4/2011
EP 3502582 A1 6/2019
JP 7085166 A 3/1995
JP 11024735 A 1/1999
JP 11317936 A 11/1999
JP 2001356813 A 12/2001
JP 2005242531 A 9/2005
JP 2005311563 A 11/2005
JP 5416066 B2 2/2014
JP 6967329 B1 11/2021
KR 1172747 B1 8/2012
KR 101445367 B1 10/2014
KR 1499081 B1 3/2015
SG 11201706843 R 9/2017
WO 9621264 A3 11/1996
WO 2004029518 A1 4/2004
WO 2005045715 A2 5/2005
WO 2008152433 A1 12/2008
WO 2008157755 A1 12/2008
WO 2009012319 A2 1/2009
WO 2009079648 A1 6/2009
WO 2010106474 A1 9/2010
WO 2011025085 A1 3/2011
WO 2011043732 A1 4/2011
WO 2011057173 A2 5/2011
WO 2011123743 A1 10/2011
WO 2013062725 A1 5/2013
WO 2013178819 A1 12/2013
WO 2014009291 A1 1/2014
WO 2014098861 A1 6/2014
WO 2014135517 A1 9/2014
WO 2016123536 A1 8/2016
WO 2017057274 A1 4/2017
WO 2019046580 A1 3/2019
WO 2020024553 A1 2/2020
WO 2022120158 A1 6/2022

OTHER PUBLICATIONS

Proliphix, Inc., "Proliphix IP Devices: HTTP API," 28 pages, Jan. 23, 2006.
Proliphix, Inc., Remote Management User Guide, 12 pages, prior to Aug. 27, 2007.
Rogan et al., "Smart and Final Food Stores: A Case Study in Web Based Energy Information and Collection," Web Based Energy Information and Control Systems: Case Studies and Application, Chapter 6, p. 59-64, 2005.
Sharp, "Actius AL3DU 3D LC Display High Performance 3D Visualization," 2 pages, prior to Mar. 17, 2006.
So et al., "Building Automation on the Information Superhighway," ASHRAE (American Society of Heating Refrigerating, and Air Conditioning) Transactions, vol. 104, Part 2, pp. 176-191, 1998.
So et al., "Building Automation Systems on the Internet," Facilities vol. 15, No. 5/6, pp. 125-133, May/Jun. 1997.
Talon, "Raptor Controller," 6 pages, Oct. 2003.
Talon, "Workstation Software," 4 pages, Nov. 2002.
Trane, "System Programming, Tracer Summit Version 14, BMTW-SVP01D-EN," 623 pages, 2002.

(56) References Cited

OTHER PUBLICATIONS

Lucid Design Group, Inc., "Building Dashboard," 2 pages, Printed May 30, 2013.
"America's Largest Managed Security Services Provider Launches Comprehensive, Integrated Covid-19 Safety Program for Office Buildings and Suites," KastleSafeSpaces, 5 pages, May 11, 2020.
"Biometric Door Reader With Body Temperature Detection," Kintronics, 9 pages, accessed May 21, 2020.
"Body Surface Temperature Screening with Alarm Function TVS-200IS/TVS-500IS," Nippon Avionics Co., 3 pages, accessed May 21, 2020.
"BriefCam announces video analytics innovation for contact tracing, physical distancing, occupancy management and face mask detection," BriefCam LTD, 11 pages, Jun. 5, 2020.
"Thermal Imaging SmartPhone Can Be used for Temperature Screening of People," CAT, 3 pages, accessed Jul. 13, 2020.
"Contact Tracing Now Available on Identiv's Hirsch Velocity Access Control Platform," IDENTIV, 5 pages, May 21, 2020.
Silva et al., "Cough localization for the detection of respiratory diseases in pig houses," ScienceDirect, 7 pages, May 28, 2008.
Oey et al., "Evaluation of Isolation Compliance Using Real Time Video in Critical Care," North Shore University Hospital, 1 page, Oct. 9, 2015.
"Facial Attendace System With Temperature Screening Now In India," IANS, 5 pages, Mar. 19, 2020.
"Plan to Re-Open," EHIGH, 16 pages, accessed Jun. 13, 2020.
"How Smarter AI-Powered Cameras Can Mitigate the Spread of Wuhan Novel," AnyConnect, 22 pages, 2020.
"How to fight COVID-19 with machine learning," DataRevenue, 20 pages, accessed May 25, 2020.
"Inncontrol 5," Honeywell, 2 pages, Aug. 8, 2018.
"IP Door Access Control," Kintronics, 21 pages, 2014.
"Kogniz AI Health Response Platform," KOGNIZ, 9 pages, accessed May 21, 2020.
"Machine Learning Could Check If You're Social Distancing Properly at Work," MIT Technology Review, 7 pages, Apr. 17, 2020.
Punn et al., "Monitoring COVID-19 social distancing with person detection and tracking via fine-tuned YOLO v3 and Deepsort techniques," 10 pages, May 6, 2020.
Burt, "NEC launches dual face biometric and fever detection system for access control," BIOMETRIC Update, 4 pages, May 8, 2020.
"Remote temperature monitoring," Axis Communication, 10 pages, 2014.
"FebriEye-AI Based Thermal Temperature Screening System," vehant, 1 page, 2020.
"See the World in a New Way Hikvision Thermal Cameras," HIKVISION, 12 pages, 2017.
Allain, "Trying out the iPhone Infrared Camera: The FLIR One," Wired, 15 pages, 2014.
Dasgupta, "Your voice may be able to tell you if you have Covid," Hindustan Times, 4 pages, Apr. 16, 2020.
Ganguty, "Gurugram-based startup Staqu has modified AI-powered Jarvis to battle coronavirus," Yourstory, 7 pages, Mar. 31, 2020.
Trane, "Creating Input/Output Objects," 196 pages, retrieved Jul. 10, 2020.
Trane, "Using the Graphing Control Editor," 181 pages, retrieved Jul. 10, 2020.
Johnson Controls Develops Industry-first AI Driven Digital Solution to Manage Clean Air, Energy, Sustainability, Comfort and Cost in Buildings, 7 pages, 2022. Accessed Aug. 29, 2022.
Johnson Controls and Microsoft Announce Global Collaboration, Launch Integration between Open Blue Digital Twin and Azure Digital Twins, 7 pages, 2022. Accessed Aug. 29, 2022.
Open Blue Companion Desktop User Guide, Johnson Controls, 18 pages, 2022.
Open Blue Digital Twin:Designed for Buildings. Infused with AI, Johnson Controls, 17 pages, 2022. Accessed Aug. 29, 2022.
Open Blue Enterprise Manager User Guide, Johnson Controls, Release 3.1, 72 pages, Jan. 28, 2021.
Open Blue Enterprise Manager User Guide, Johnson Controls, Release 4.0, 78pages, Nov. 29, 2021.
Open Blue Location Manager User Guide, Johnson Controls, Release 2.4.7, 28 pages, Jul. 20, 2022.
Open Blue Enterprise Manager, Optimize Building Portfolio Performance with Advanced Data Analytics and AI, Johnson Controls, 20 pages, Accessed Aug. 29, 2022.
Open Blue Platform, Make Smarter, Faster, More Data-Driven Decisions, Johnson Controls, 15 pages, 2022. Accessed Aug. 29, 2022.
Open Blue, Now, Spaces have Memory and Identity, Johnson Controls, 20 pages, 2022. Accessed Feb. 10, 2022.
Open Blue Enterprise Manager User Guide, Johnson Controls, 108 pages, Release 4.1.3, 2022, Accessed Aug. 29, 2022.
Risbeck et al; "Modeling and Multiobjective Optimization of Indoor Airborne Disease Transmission Risk and Associated Energy Consumption for Building HVAC Systems," Energy and Buildings, vol. 253, 24 pages, 2021.
Sinha et al; "Balance Infection Risk, Sustainability and Comfort with Open Blue," Johnson Controls, 2 pages, 2021.
Building Automation System in Michigan, Johnson Heating and Cooling, L.L.C., www.cooljohnson.com/Building-Automation-Systems-Michigan/Macomb-County-Michigan/Building-Automation-Confidential-Customer.html, 4 pages, Accessed Nov. 21, 2022.
Building Automation System Waterford Michingan 48328 JLA, Johnson Heating and Cooling L.L.C., www.cooljohnson.com/Building-Automation-Systems-Michigan/Waterford-Michigan/Building-Automation-System-JLA.html, 3 pages, Accessed Nov. 21, 2022.
Building Automation Systems Waterford Michigan 48330 SJMO, Johnson Heating and Cooling, L.L.C., www.cooljohnson.com/Building-Automation-Systems-Michigan/Waterford-Michigan/Building-Automation-Systems-SJMO.html, 2 pages, Accessed Nov. 21, 2022.
Building Automation Systems Waterford Michigan 48329 WIM, Johnson Heating and Cooling L.L.C., www.cooljohnson.com/Building-Automation-Systems-Michigan/Building-Automation-Systems-WIM.html, 3 pages, accessed Nov. 21, 2022.
Building Automation Clawson Michigan 2.0, Johnson Heating and Cooling L.L.C., www.cooljohnson.com/Building-Automation-Systems-Michigan/Clawson-Michigan/Building-Automation-Clawson-Manor-2.html, 6 pages, Accessed Nov. 21, 2022.
Building Automation in Detroit—Mosaic Christian, Johnson Heating and Cooling L.L.C., www.cooljohnson.com/Building-Automation-Systems-Michigan/Detroit/Mosaic-Christian.html, 5 pages, Accessed Nov. 21, 2022.
Building Automation in Michigan—Divine Grace, Johnson Heating and Cooling L.L.C., www.cooljohnson.com/Building-Automation-Systems-Michigan/Oakland-County-Michigan/Building-Automation-Divine-Grace.html, 3 pages, Accessed Nov. 21, 2022.
Building Automation System Plymouth, Michigan, Johnson Heating and Cooling L.L.C., www.cooljohnson.com/Building-Automation-Systems-Michigan/Plymouth-Michigan/Building-Automation-System-Plymouth-Michigan.html, 8 pages, Accessed Nov. 21, 2022.
Building Automation Systems Shelby Michigan 48316 SG, Johnson Heating and Cooling L.L.C., www.cooljohnson.com/Building-Automation-Systems-Michigan/Shelby-Township-Michigan/Building-Automation-Systems-SG.html, 3 pages, Accessed Nov. 21, 2022.
Building Automation System St. Clair County, Michigan, Johnson Heating and Cooling L.L.C., www.cooljohnson.com/building-Automation-Systems-Michigan/St-Clair-Michigan/Building-Automation-system-St-Clair-Michigan.html, 4 pages, Accessed Nov. 21, 2022.
Building Automation System Troy Michigan Oakland Mall, Johnson Heating and Cooling L.L.C., www.cooljohnson.com/Building-Automation-Systems-Michigan/Troy Michigan/Building-Automation-System-Oakland-Mall.html, 4 pages, Accessed Nov. 21, 2022.
Building Automation System Waterford Michigan 48327 Excel, Johnson Heating and Cooling L.L.C., www.cooljohnson.com/Building-Automation-Systems-Michigan/Waterford-Michigan/Building-Automation-System-excel.html, 2 pages, Accessed Nov. 22, 2022.

(56) References Cited

OTHER PUBLICATIONS

Building Automation System Romeo Michigan 48065 RomeoPR, Johnson Heating and Cooling, L.L.C., www.cooljohnson.com/Building-Automation-Systems-Michigan/Romeo-Michigan/Building-Automation-System-RomeoPR.html, 2 pages, Accessed Nov. 21, 2022.
Johnson, Jr., "Cooling Logic™: Changing the Way You Cool," Johnson Solid State, LLC, 12 pages, Nov. 7, 2018.
Building Automation System Clawson Michigan Clawson Manor, Johnson Heating and Cooling L.L.C., www.cooljohnson.com/building-Automation-Systems-michigan/clawson-Michigan/building-Automation-System-Clawson-Manor.html, 3 pages, Accessed Nov. 21, 2022.
Johnson, Jr., "CoolingLogic™ A Method to increase HVAC System Efficiency and Decrease Energy Consumption," A White Paper, Johnson Solid State, L.L.C., 51 pages, Sep. 24, 2016.
Johnson, Jr., "CoolingLogic™: Mosaic Christian Church a Case Study," 140 pages, Feb. 2, 2019.
Rosenberg, "Analyzing Air Handling Unit Efficiency," Onset Computer Corporation, Bourne, Massachusetts, 24 pages, 2014, www.onsetcomp.com.
Cigler, et al; "Optimization of Predicted Mean Vote Index within Model Predictive Control Framework: Computationally Tractable Solution." Energy and Buildings 52, 39-49, (2012).
Cigler, et al; "On the Selection of the Most Appropriate MPC Problem Formulation for Buildings." In11th REHVA World Congress CLIMA 2013, No. CONF. 2013.
Walker, et al; "Application of Distributed Model Predictive Approaches to Temperature and CO2 Concentration Control in Buildings." IFAC-PapersOnLine50, No. 1 (2017): 2589-2594, 2017.
Iranmanesh et al; "Soft Switching Model Predictive Control with an Increase in the Security of Calculations and Information." J. Comput., 13(9), 1115-1126 (2018).
Drgona, et al; "All you need to know about Model Predictive Control for Buildings." Annual Reviews in Control (2020).
Chen et al; "Indoor Air Quality Monitoring System for Smart Buildings," UbiComp, Seattle, Washington, 5 pages, 2014.
Reset Pre-Release, 96 pages, 2017.
Shen et al., "A Systematic Approach to Estimating the Effectiveness of Multi-Scale IAQ Strategies for Reducing Risk of Airborne Infection of SARS-CoV-2," Building and Environment, vol. 200, 20 pages, 2021.
Extended European Search Report, EP Application No. 24172206.5, European Patent Office, Oct. 16, 2024 (9 pages).
Bocicor et al. "Wireless Sensor Network based System for the Prevention of Hospital Acquired Infections", arxiv.org, Cornell University Ithaca, NY 14853, May 2, 2017, XP080947042, (Abstract).
Shhedi et al., "Traditional and ICT Solutions for Preventing the Hospital Acquired Infection", 2015 20th International Conference on Control Systems and Computer Science, IEEE, May 27, 2015, pp. 867-873, XP033188038.
Extended European Search Report, EP application No. 20151295.1, pp. 13, May 26, 2020.
Breen et al., "From Chip to Cooling Tower Data Center Modeling: Part I Influence of Server Inlet Temperature and Temperature Rise across Cabinet," IEEE, 10 pages, 2010.
www.geappliances.com/home-energy-manager/about-energy-monitors.htm, "Energy Monitor, Home Energy Monitors, GE Nucleus," 2 pages, printed Jan. 15, 2013.
www.luciddesigngroup.com/network/apps.php#/homepage, "Lucid Design Group—Building Dashboard Network—Apps," 7 pages, Jan. 15, 2013.
Preuveneers et al., "Intelligent Widgets for Intuitive Interaction and Coordination in Smart Home Environments," IEEE Eighth International Conference on Intelligent Environments, pp. 157-164, 2012.
Wu et al., "A Web 2.0 Based Scientific Application Framework," 7 pages, prior to Jul. 24, 2014.
"4.0 Today's Activities, The Home Dashboard," CRBM info@hand website, 46 pages, prior to Apr. 25, 2013.
"Free Facilities Dashboards," eSight Energy Website, 2 pages, prior to Apr. 25, 2013.
Alerton Building Controls, Gallery Prints, 7 pages, Dec. 19, 2013.
Carter, "Industrial Energy Management Dashboards Require a Toolkit," Cross Automation, 11 pages, Nov. 4, 2013.
Buonanno et al., "Estimation of Airborne Viral Emission: Quanta Emission Rate of SARS-Co-V-2 for Infection Risk Assessment," Environment International, vol. 141, 9 pages, 2020.
Goyal et al., "Experimental Study of Occupancy-Based Control of HVAC Zones," Applied Energy, vol. 140, pp. 75-84, 2015.
Wikipedia, Standard Score, 6 pages, 2023. Accessed Feb. 6, 2023. https://en.wikipedia.org/wiki/Standard_score.
Yani, "Developing a Novel Dedicated Outdoor Air System (DOAS) for Energy Efficiency and Environmental Health," Pao Yue-kong Library, The Hong Kong Polytechnic University, Hung Hom, Kowloon, Hong Kong, 175 pages, 2018. http://www.lib.polyu.edu.hk.
e-homecontrols.com, "e-Home Controls Website," link to actual website no longer works, 1 page, prior to Dec. 19, 2013.
http://www.ccbac.com, "C&C (/)—Omniboard," 5 pages, Dec. 19, 2013.
http://www.domcontroller.com/en/, "DomController Home Automation Software—Control Anything from Anywhere," 11 pages, printed Jan. 6, 2015.
http://www.novar.com/ems-bas/opus-building-automation-system, "Novar OPUS BAS," 1 page, prior to Feb. 13, 2013.
Instituto Superior Tecnico, "A 3D Interactive Environment for Automated Building Control," Master's Dissertation, 120 pages, Nov. 2012.
Panduit Corp., "Enable a Building Automation with Panduit Enterprise Solutions," 4 pages, Nov. 2012.
"WEBs-AX Web-Enabled Building Solutions," sales brochure, Honeywell International Inc., Mar. 2009.
"Attune Advisory Services," press release, Honeywell International Inc., Mar. 20, 2012.
enteliWEB product from Delta Controls, web pages retrieved on May 9, 2013 from http://deltacontrols.com/products/facilities-management/supervisory-software et seq. by the Internet Archive at web.archive.org.
"BACnet Protocol Implementation Conformance Statement" for enteliWEB, Delta Controls, Jul. 17, 2013.
Castle, "7 Software Platforms that Make Building Energy Management Easy," http://greentechadvocates.com/2012/11/28/7-software-platforms-that-make-building-energy-managment-easy/, Nov. 28, 2012.
enteliWEB catalog sheet, Delta Controls, Inc., 2012.
enteliWEB catalog sheet, Delta Controls., 2010.
"Intelligent Building Management Systems in Miami," Advanced Control Corp., Mar. 7, 2013.
"The Ohio State University," BACnet International Journal, vol. 5, p. 4, Jan. 2013.
Bobker et al., "Operational Effectiveness in Use of BAS," Proceedings of the 13th International Conference for Enhanced Building Operations, Oct. 8, 2013.
Castelo, "A 3D Interactive Environment for Automated Building Control," Elsevier, Nov. 8, 2012.
"Creston Special Report: How Intelligent building management solutions are reducing operational costs," Creston, 2012.
"Building Automation Software Solutions," Iconics, 2013.
Lacey, "The Top 10 Software Vendors Connecting Smart Buildings to the Smart Grid," http://www.greentechmedia.com/articles/read/the-top-10-companies-in-enterprise-smart-grid, Jul. 18, 2013.
"NiagraAX Product Model Overview," Tridium, Inc., 2005.
"An Overview of NiagraAX: A comprehensive software platform designed to create smart device applications," Tridium, Inc., 2005.
"Phoenix Controls Portal," Phoenix Controls, Inc., 2013.
Quirk, "A Brief History of BIM," Arch Daily, Dec. 7, 2012.
Samad et al., "Leveraging the Web: A Universal Framework for Building Automation," Proceedings of the 2007 American Control Conference, Jul. 11, 2007.
Sinha et al., "9 Key attributes of energy dashboards and analytics tools," https://www.greenbiz.com/blog/2013/08/28/9-key-attributes-energy-dashboards-and=analytics-tools, Aug. 28, 2013.

(56) References Cited

OTHER PUBLICATIONS

Sinopoli, "Dashboards for Buildings," http://www/automatedbuildings.com/news/dec10/articles/sinopoli/101119034404sinopoli.html, Dec. 2010.
Sinopoli, "Modeling Building Automation and Control Systems," http://www.automatedbuildings.com/news/jun13/articles/sinopoli/130521122303sinopoli.html, Jun. 2013.
Zito, "What is Tridium Part 1," http://blog.buildingautomationmonthly.com/what-is-tridium/, May 12, 2013.
Zito, "What is Tridium Part 2," http://blog.buildingautomationmonthly.com/tridium-part-2/, Sep. 10, 2013.
Search Report and Written Opinion from related International PCT Application No. PCT/US2018/025189 dated Jul. 17, 2018 (12 pages).
"Data analytics and smart buildings increase comfort and energy efficiency", https://www.microsoft.com/itshowcase/Article/Content/845/Data-analytics-and-smart-buildings-increase-comfort-and-energy-efficiency, Dec. 19, 2016, 8 pages.
Donnelly, "Building Energy Management: Using Data as a Tool", http://www.buildingefficiencyinitiative.org/sites/default/files/legacy/InstituteBE/media/Library/Resources/Existing-Building-Retrofits/Using-Building-Data-as-a-Tool.pdf, Oct. 2012, 9 pages.
"Ashrae Dashboard Research Project," 29 pages, Aug. 28, 2008.
"Energy Manager User Guide," Release 3.2, Honeywell, 180 pages, 2008.
"Fuzzy Logic Toolbox 2.1, Design and Stimulate Fuzzy Logic Systems," The MathWorks, 2 pages, May 2004.
"Junk Charts, Recycling Chartjunk as junk art," 3 pages, Oct. 2, 2006.
"Model Predictive Control Toolbox 2, Develop Internal Model-Based Controllers for Constrained Multivariable Processes," The MathWorks, 4 pages, Mar. 2005.
Honeywell, "Product Guide 2004," XP-002472407, 127 pages, 2004.
"Statistics Toolbox, for Use with Matlab," User's Guide Version2, The MathWorks, 408 pages, Jan. 1999.
"Vykon Energy Suite Student Guide," Tridium Inc., 307 pages, Mar. 3, 2006.
"Web Based Energy Information Systems for Energy Management and Demand Response in Commercial Buildings," California Energy Commission, 80 pages, Oct. 2003.
Andover Controls, Network News, vol. 2, No. 2, 8 pages, 1997.
Andover Controls World, 4 pages, Spring 1997.
Bell et al., "Early Event Detection-Results from A Prototype Implementation," AICHE Spring National Meeting, 15 pages, Apr. 2005.
Cadgraphics, "The Cadgraphics User's Guide," 198 pages, 2003.
Carrier Comfort Network CCN Web, "Web Browser User Interface to the Carrier Comfort Network," 2 pages, 2002.
Carrier Comfort Network CCN Web, Overview and Configuration Manual, 134 pages, Apr. 2006.
Carrier Comfort Network CCN Web, Product Data, 2 pages, Apr. 2006.
Carrier, "i-Vu Powerful and Intuitive Front End for Building Control," 2 pages, Aug. 2005.
Carrier, "i-Vu Web-Based Integrated Control System," 3 pages, 2005.
Carrier, Demo Screen Shots, 15 pages, prior to Aug. 27, 2007.
Carrier, i-Vu CCN 4.0, Owner's Guide, 20 pages, Jul. 2007.
Carrier, i-Vu CCN, 7 pages, 2007.
Chan, Tony. F., "Rank Revealing QR Factorizations," Linear Algebra and It's Applications, vol. 88-89, p. 67-82, Apr. 1987.
Circon, "i-Browse Web-Based Monitoring and Control for Facility Management," 2 pages, prior to Aug. 27, 2007.
Published Australian Application 2009904740, 28 pages, Application Filed on Sep. 29, 2009.
Echelon, "Energy Control Solutions with the i.Lon SmartServer," 4 pages, 2007.
Echelon, "i.Lon 100e3 Internet Server Models 72101R-300, 72101R-308, 72102R-300, 72103-R300 . . . " 5 pages, copyright 2002-2007.
Echelon, "i.Lon 100e3 Internet Server New Features," 15 pages, Sep. 2006.
Echelon, "i.Lon SmartServer," 5 pages, 2007.
Honeywell News Release, "Honeywell's New Sysnet Facilities Integration System for Boiler Plant and Combustion Safety Processes," 4 pages, Dec. 15, 1995.
Honeywell, "Excel Building Supervisor-Integrated R7044 and FS90 Ver. 2.0," Operator Manual, 70 pages, Apr. 1995.
Honeywell, "Introduction of the S7350A Honeywell WebPAD Information Appliance," Home and Building Control Bulletin, 2 pages, Aug. 29, 2000; Picture of WebPad Device with touch screen, 1 Page; and screen shots of WebPad Device, 4 pages.
Honeywell, Excel 15B W7760B Building Manager Release 2.02.00, Installation Instructions, 28 pages, Dec. 2004.
Honeywell, The RapidZone Solution, Excel 5000 Open System, Application Guide, 52 pages, Jan. 2004.
http://pueblo.lbl.gov/~olken . . . , "Remote Building Monitoring and Operations Home Page," 5 pages, prior to Aug. 27, 2007.
http://www.commercial.carrier.com/commercial/hvac/productdescription . . . , "Carrier: i-Vu CCN," 1 page, printed Mar. 11, 2008.
http://www.commercial.carrier.com/commercial/hvac/productdescription . . . , "Carrier: 33CSCCNWEB-01 CCN Web Internet Connection to the Carrier Comfort Network," 1 page, printed Mar. 11, 2008.
http://www.docs.hvacpartners.com/idc/groups/public/documents/techlit/gs-controls-ivuccn.rtf, "Products," 5 pages, printed Jul. 3, 2007.
http://www.lightstat.com/products/istat.asp, Lightstat Incorporated, "Internet Programmable Communicating Thermostats," 1 page, printed Mar. 13, 2007.
http://www.sharpsystems.com/products/pc_notebooks/actius/rd/3d/, "Actius RD3D Desktop Replacement Notebook with Industry-Breakthrough 3D Screen," Sharp, 1 page, printed Jun. 16, 2005.
http://www2.sims.berkeley.edu/courses/is213/s06/projects/lightson;final.html, "Lights on a Wireless Lighting Control System," 11 pages, printed Mar. 22, 2007.
i.Lon 100e3 Internet Server, 1 page, prior to Aug. 27, 2007.
i.Lon, SmartServer, 2 pages, prior to Aug. 27, 2007.
i-stat, Demo Screen Shots, 9 pages, printed Mar. 13, 2007.
i-stat, The Internet Programmable Thermostat, 2 pages, prior to Aug. 27, 2007.
Ball, "Green Goal of 'Carbon Neutrality' Hits Limit," TheWall Street Journal, 7 pages, Dec. 30, 2008.
Johnson Controls, Network Integration Engine (NIE) 3 pages, Nov. 9, 2007.
Johnson Controls, Network Integration Engine (NIE), Product Bulletin, pp. 1-11, Jan. 30, 2008.
Kourti, "Process Analysis and Abnormal Situation Detection: From Theory to Practice," IEEE Control Systems Magazine, p. 10-25, Oct. 2002.
Mathew, "Action-Oriented Benchmarking, Using CEUS Date to Identify and Prioritize Efficiency Opportunities in California Commercial Buildings," 26 pages, Jun. 2007.
Morrison et al., "The Early Event Detection Toolkit," Honeywell Process Solutions, 14 pages, Jan. 2006.
Narang, "Webarc: Control and Monitoring of Building Systems Over the Web," 53 pages, May 1999.

* cited by examiner

METHOD AND SYSTEM FOR CONTROLLING A FRESH AIR INTAKE OF AN AIR HANDLING UNIT OF AN HVAC SYSTEM

TECHNICAL FIELD

The present disclosure relates to methods and systems for operating a Heating, Ventilating and Air Conditioning (HVAC) system.

BACKGROUND

HVAC systems provide conditioned air for heating and cooling the interior of a building. Some HVAC systems also can provide fresh air ventilation into the building while exhausting an equivalent amount of inside air. Such fresh air ventilation is useful in reducing contaminates produced in the building. However, there are often costs involved in conditioning the fresh air before it can be deployed in the building. For example, in the winter, the cold fresh air must typically be heated by the HVAC system, and in some cases, humidity must be added. Likewise, in the summer, the warm fresh air must typically be cooled by the HVAC system, and in some cases, humidity must be removed. Thus, to reduce operating costs, it is often desirable to minimize the ventilation rate while still adequately ventilating the building given the current contaminates or expected contaminates in the building.

Under some conditions, such as during a pandemic, it may be desirable to prioritize an increased ventilation rate over energy costs to help reduce the spread of pathogens within the building. Under these conditions, if the ventilation rate is set too high, given the current indoor and outdoor conditions, the HVAC system may lack the heating and/or cooling capacity to adequately condition the incoming fresh air while still maintaining occupant comfort in the building. What would be desirable are methods and systems for operating an HVAC system to provide adequate ventilation while minimizing energy usage and maintaining comfort.

SUMMARY

The present disclosure relates to methods and systems for operating a Heating, Ventilating and Air Conditioning (HVAC) system. An example may be found in a method for controlling a fresh air intake of an Air Handling Unit (AHU) of an HVAC (Heating, Ventilating and Air Conditioning) system servicing a building space. In this example, the AHU includes a fresh air intake damper for admitting a fresh air ventilation air flow, a return air duct for receiving return air from the building space, a mixed air duct for mixing the fresh air ventilation air flow from the fresh air intake damper and return air from the return air duct and providing a mixed air flow to a heating and/or cooling unit of the AHU which supplies a supply air flow to the building space. The AHU further includes a fan for providing a motive force to move the return air, the fresh air ventilation air flow, the mixed air flow and the supply air flow through the AHU. The illustrative method includes determining a fresh air intake damper position for the fresh air intake damper based at least in part on one or more of a measure of flow rate of the supply air flow, a measure of energy delivered by the heating and/or cooling unit to the supply air flow, and a measure of humidity of the supply air flow. Determining the fresh air intake damper position is subject to two or more constraints including a constraint that the AHU maintains one or more comfort conditions in the building space and one or more of a constraint that the AHU maintains one or more Indoor Air Quality (IAQ) contaminants in the building space below one or more IAQ thresholds, a constraint that the AHU minimizes energy consumption of the AHU, and a constraint that the AHU maximizes the fresh air ventilation air flow into the building space.

In some instances, determining the fresh air intake damper position includes one or more of determining the measure of flow rate of the supply air flow based on a signal representing a current fan speed of the fan of the AHU and a predetermined flow rate of the fan at each of one or more predetermined fan speeds; determining the measure of energy delivered by the heating and/or cooling unit based on a signal representing an inlet temperature of a heating and/or cooling fluid entering the heating and/or cooling unit through a control valve, a signal representing an outlet temperature of the heating and/or cooling fluid exiting the heating and/or cooling unit, a signal representing a current valve position of the control valve and a predetermined flow rate of heating and/or cooling fluid at each of one or more predetermined valve positions of the control valve; and determining the measure of humidity of the supply air flow based on a signal representing a relative humidity of the fresh air ventilation air flow, a signal representing a flow rate of the fresh air ventilation air flow, a signal representing a relative humidity of the return air, and a signal representing a flow rate of the return air. The method includes setting the fresh air intake damper to the determined fresh air intake damper position during a subsequent operation of the AHU.

Another example may be found in an Air Handling Unit (AHU) of an HVAC (Heating, Ventilating and Air Conditioning) system for servicing a building space. In this example, the AHU includes a fresh air intake damper for admitting a fresh air ventilation air flow, a return air duct for receiving return air from the building space, a heating and/or cooling unit, a mixed air duct for mixing the fresh air ventilation air flow from the fresh air intake damper and return air from the return air duct and providing a mixed air flow to the heating and/or cooling unit of the AHU which supplies a supply air flow to the building space, a fan for providing a motive force to move the return air, the fresh air ventilation air flow, the mixed air flow and the supply air flow through the AHU, and a controller operatively coupled to the fresh air intake damper, the heating and/or cooling unit and the fan. The controller is configured to determine a fresh air intake damper position for the fresh air intake damper based at least in part on one or more of a measure of flow rate of the supply air flow, a measure of energy delivered by the heating and/or cooling unit to the supply air flow, and a measure of humidity of the supply air flow. The fresh air intake damper position is subject to two or more constraints including a constraint that the AHU maintains one or more comfort conditions in the building space and one or more of a constraint that the AHU maintains one or more Indoor Air Quality (IAQ) contaminants in the building space below one or more IAQ thresholds, a constraint that the AHU minimizes energy consumption of the AHU, and a constraint that the AHU maximizes the fresh air ventilation air flow into the building space. The controller when determining the fresh air intake damper position is configured to include one or more of determining the measure of flow rate of the supply air flow based on a signal representing a current fan speed of the fan of the AHU and a predetermined flow rate of the fan at each of one or more predetermined fan speeds; determining the measure of energy delivered by the heating and/or cooling unit based on a signal representing an inlet temperature of a heating and/or cooling fluid entering the heating and/or cooling unit through a control valve, a signal representing an outlet temperature of the heating and/or cooling fluid exiting the heating and/or cooling unit, a signal representing a current valve position of the control valve and a predetermined flow rate of heating and/or cooling fluid at each of one or more predetermined valve positions of the control valve; and determining the measure of humidity of the supply air flow based on a signal representing a relative humidity of the fresh air ventilation air flow, a signal representing a flow rate of the fresh air ventilation air flow, a signal representing a relative humidity of the return air, and a signal representing a flow rate of the return air. The controller is configured to set the fresh air intake damper to the determined fresh air intake damper position.

Another example may be found in a non-transitory computer readable medium storing instructions thereon that when executed by one or more processors cause the one or more processors to control a fresh air intake damper of an Air Handling Unit (AHU) of an HVAC (Heating, Ventilating and Air Conditioning) system servicing a building space. In this example, the AHU includes a fresh air intake damper for admitting a fresh air ventilation air flow, a return air duct for receiving return air from the building space, a heating and/or cooling unit, a mixed air duct for mixing the fresh air ventilation air flow from the fresh air intake damper and return air from the return air duct and providing a mixed air flow to the heating and/or cooling unit of the AHU which supplies a supply air flow to the building space and a fan for providing a motive force to move the return air, the fresh air ventilation air flow, the mixed air flow and the supply air flow through the AHU. The instructions cause the one or more processors to determine a fresh air intake damper position for the fresh air intake damper based at least in part on one or more of a measure of flow rate of the supply air flow, a measure of energy delivered by the heating and/or cooling unit to the supply air flow, and a measure of humidity of the supply air flow. The fresh air intake damper position is subject to two or more constraints including a constraint that the AHU maintains one or more comfort conditions in the building space and one or more of a constraint that the AHU maintains one or more Indoor Air Quality (IAQ) contaminants in the building space below one or more IAQ thresholds, a constraint that the AHU minimizes energy consumption of the AHU, and a constraint that the AHU maximizes the fresh air ventilation air flow into the building space. When determining the fresh air intake damper position, the instructions cause the one or more processor to perform one or more of determining the measure of flow rate of the supply air flow based on a signal representing a current fan speed of the fan of the AHU and a predetermined flow rate of the fan at each of one or more predetermined fan speeds; determining the measure of energy delivered by the heating and/or cooling unit based on a signal representing an inlet temperature of a heating and/or cooling fluid entering the heating and/or cooling unit through a control valve, a signal representing an outlet temperature of the heating and/or cooling fluid exiting the heating and/or cooling unit, a signal representing a current valve position of the control valve, and a predetermined flow rate of heating and/or cooling fluid at each of one or more predetermined valve positions of the control valve; determining the measure of humidity of the supply air flow based on a signal representing a relative humidity of the fresh air ventilation air flow, a signal representing a flow rate of the fresh air ventilation air flow, a signal representing a relative humidity of the return air, and a signal representing a flow rate of the return air. The one or more processors are caused to set the fresh air intake damper to the determined fresh air intake damper position.

The preceding summary is provided to facilitate an understanding of some of the innovative features unique to the present disclosure and is not intended to be a full description. A full appreciation of the disclosure can be gained by taking the entire specification, claims, figures, and abstract as a whole.

BRIEF DESCRIPTION OF THE FIGURES

The disclosure may be more completely understood in consideration of the following description of various examples in connection with the accompanying drawings, in which.

Figure 1:
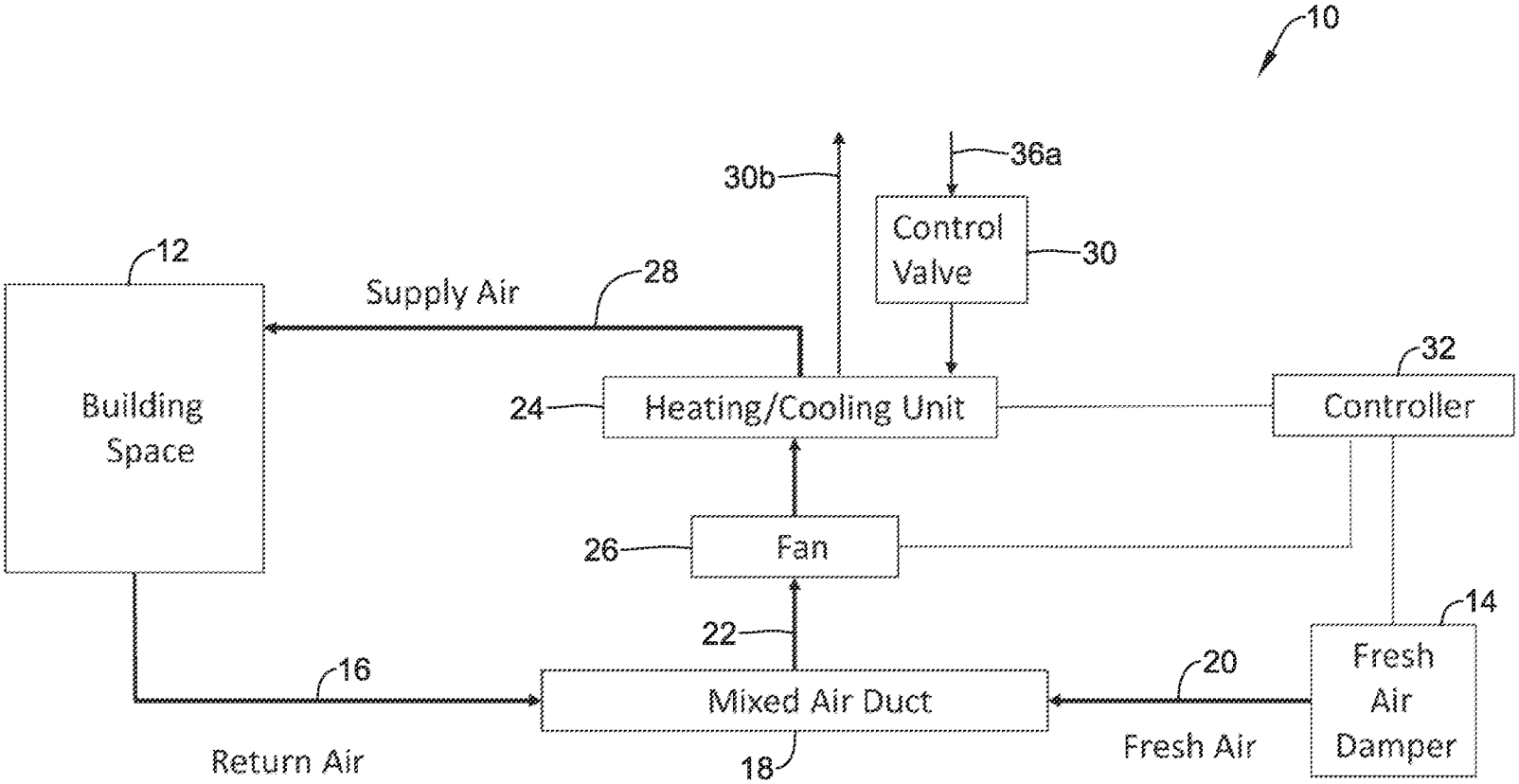
FIG. 1 is a schematic block diagram showing an illustrative Air Handling Unit (AHU) that forms part of a Heating, Ventilating and Air Conditioning (HVAC) system servicing a building space.

While the disclosure is amenable to various modifications and alternative forms, specifics thereof have been shown by way of example in the drawings and will be described in detail. It should be understood, however, that the intention is not to limit the disclosure to the particular examples described. On the contrary, the intention is to cover all modifications, equivalents, and alternatives falling within the spirit and scope of the disclosure.

DESCRIPTION

The following description should be read with reference to the drawings, in which like elements in different drawings are numbered in like fashion. The drawings, which are not necessarily to scale, depict examples that are not intended to limit the scope of the disclosure. Although examples are illustrated for the various elements, those skilled in the art will recognize that many of the examples provided have suitable alternatives that may be utilized.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic is described in connection with an embodiment, it is contemplated that the feature, structure, or characteristic may be applied to other embodiments whether or not explicitly described unless clearly stated to the contrary.

FIG. 1 is a schematic block diagram showing an illustrative Air Handling Unit (AHU) 10 that may form part of a Heating, Ventilating and Air Conditioning (HVAC) system servicing a building space 12. The building space 12 may represent an entire building, for example, or a single floor or zone within a building. The AHU 10 includes a fresh air intake damper 14 for admitting a fresh air ventilation flow from outside of the building. The AHU 10 includes a return air duct 16 for receiving return air from the building space 12. The AHU 10 includes a mixed air duct 18 for mixing a fresh air ventilation air flow 20 from the fresh air intake damper 14 and return air from the return air duct 16 and provides a mixed air flow 22. The mixed air flow 22 flows to a heating and/or cooling unit 24. In some instances, as shown, a fan 26 may be disposed between the mixed air duct 18 and the heating and/or cooling unit 24. In some instances, the heating and/or cooling unit 24 may be disposed between the mixed air duct 18 and the fan 26. In either case, the fan 26 provides a motive force to move the return air within the return air duct 16 and the fresh air ventilation air flow 20. In some instances, the fan 26 also provides a motive force to move the supply air flow 28. The heated or cooled air exiting the heating and/or cooling unit 24 represents a supply air flow 28. In some instances, the AHU 10 may include one fan 26, or may include two or more fans 26. The AHU 10 includes a control valve 30 that is configured to control the flow of a heating or cooling fluid into the heating and/or cooling unit 24, including an inlet flow 30*a* and an outlet flow 30*b*.

A controller 32 is operatively coupled to the fresh air intake damper 14, the heating and/or cooling unit 24 and the fan 26. The controller 32 is configured to determine a fresh air intake damper position for the fresh air intake damper 14 based at least in part on one or more of a measure of flow rate of the supply air flow 28, a measure of energy delivered by the heating and/or cooling unit to the supply air flow 28, and a measure of humidity of the supply air flow 28.

In some instances, the fresh air intake damper position is subject to two or more constraints including a constraint that the AHU 10 maintains one or more comfort conditions (e.g. temperature) in the building space 12 and one or more of a constraint that the AHU 10 maintains one or more Indoor Air Quality (IAQ) contaminants (e.g. $CO_2$, $PM_{2.5}$ and/or TVOC) in the building space 12 below one or more IAQ thresholds, a constraint that the AHU 10 minimizes energy consumption of the AHU 10, and a constraint that the AHU 10 maximizes the fresh air ventilation air flow 20 into the building space 12.

In some instances, the controller 32, when determining the fresh air intake damper position, may be configured to determine the measure of flow rate of the supply air flow 28 based on a signal representing a current fan speed of the fan 26 of the AHU 10 and a predetermined flow rate of the fan 26 at each of one or more predetermined fan speeds. The predetermined flow rate of the fan 26 at each of one or more predetermined fan speeds may be taken from a data sheet from the manufacturer of the fan 26, or may be measured during a characterization of the fan 26.

The controller 32 may be configured to determine the measure of energy delivered by the heating and/or cooling unit 24 based on a signal representing an inlet temperature of a heating and/or cooling fluid entering the heating and/or cooling unit 24 through a control valve, a signal representing an outlet temperature of the heating and/or cooling fluid exiting the heating and/or cooling unit 24, a signal representing a current valve position of the control valve 30, and a predetermined flow rate of heating and/or cooling fluid at each of one or more predetermined valve positions of the control valve 30. In some cases, the heating and/or cooling unit 24 may include temperature sensors that measure the inlet temperature of the heating and/or cooling fluid entering the heating and/or cooling unit 24 through the control valve and the outlet temperature of the heating and/or cooling fluid exiting the heating and/or cooling unit 24. The predetermined flow rate of the heating and/or cooling fluid at each of one or more predetermined valve positions of the control valve 30 may be taken from a data sheet from the manufacturer of the AHU 10, or may be measured during a characterization of the AHU 10.

In some instances, the controller 32 may be configured to determine the measure of humidity of the supply air flow 28 based on a signal representing a relative humidity of the fresh air ventilation air flow 20, a signal representing a flow rate of the fresh air ventilation air flow 20, a signal representing a relative humidity of the return air flowing through the return air duct 16, and a signal representing a flow rate of the return air flowing through the return air duct 16. The controller is configured to set the fresh air intake damper 14 to the determined fresh air intake damper position during a subsequent operation of the AHU 10.

In some instances, the controller 32 may be configured to determine the measure of flow rate of the supply air flow 28 based on the signal representing the current fan speed of the fan 26 of the AHU 10 and the predetermined flow rate of the fan 26 at each of one or more predetermined fan speeds. In some instances, the measure of flow rate of the supply air flow 28 may be determined in accordance with the equation:

$$CFM = \frac{RPM}{\text{design } RPM} \times \text{design } CFM,$$

where:

- CFM represents the flow rate of the supply air flow 28 in Cubic Feet per Minute (CFM);
- RPM represents the current fan speed of the fan 26 of the AHU 10 in Revolutions Per Minute (RPM);
- design RPM represents one of the one or more predetermined fan speeds of the fan 26 (e.g. from a data sheet of the fan 26); and
- design CFM represents the predetermined flow rate at the one of the one or more predetermined fan speeds of the fan 26 (design RPM) (e.g. from the data sheet of the fan 26).

In some instances, the controller 32 may be configured to determine the measure of energy delivered by the heating and/or cooling unit 24 based on the signal representing the inlet temperature of the heating and/or cooling fluid entering the heating and/or cooling unit 24, the signal representing an outlet temperature of the heating and/or cooling fluid exiting the heating and/or cooling unit 24, the signal representing the current valve position of the control valve 30 and the predetermined flow rate of heating and/or cooling fluid at each of one or more predetermined valve positions of the control valve 30. In some instances, the measure of energy is determined in accordance with the equation:

$$Q=mc\Delta T$$

where:

- Q represents the measure of energy delivered by the heating and/or cooling unit 24;
- m represents the mass flow rate of the heating and/or cooling fluid flowing through the heating and/or cooling unit 24;
- c represents the specific heat capacity of the heating and/or cooling fluid; and
- ΔT represents a temperature difference between the inlet temperature and the outlet temperature of the heating and/or cooling fluid.

In some instances, the controller 32 may be configured to determine the measure of humidity of the supply air flow based on the signal representing the relative humidity of the fresh air ventilation air flow 20, the signal representing the flow rate of the fresh air ventilation air flow 20, the signal representing the relative humidity of the return air 16, and the signal representing the flow rate of the return air. In some instances, the measure of humidity may be determined in accordance with the equation:

$$\text{Mixed air } rH: \left(OA\,rH * \frac{OA \text{ flow rate}}{OA \text{ flow rate} + RA \text{ flow rate}}\right) + \left(RA\,rH * \frac{RA \text{ flow rate}}{OA \text{ flow rate} + RA \text{ flow rate}}\right),$$

where:

- Mixed air rH represents a measure of relative humidity of the mixed air flow 22;
- OA rH represents the relative humidity of the fresh air ventilation air flow 20, sometimes measured by a fresh air or outside air humidity sensor;
- OA flow rate represents the flow rate of the fresh air ventilation air flow 20;
- RA rH represents the relative humidity of the return air 16 flowing within the return air duct 16, sometimes measured by a return air humidity sensor or a humidity sensor in the building space 12; and
- RA flow rate represents the flow rate of the return air flowing within the return air duct 16.

The flow rate of the fresh air ventilation air flow 20 may be determined by, for example, directly measuring the fresh air ventilation air flow 20 using a flow rate sensor, deriving the fresh air ventilation air flow 20 from a relationship between the supply air flow 28 and the current position of the fresh air intake damper 14, deriving the fresh air ventilation air flow 20 by subtracting the return air flow 16 from the supply air flow 28, or in any other suitable way. The controller 32 may be configured to set the measure of humidity of the supply air flow 28 equal to the measure of relative humidity of the mixed air flow (Mixed air rH) 22.

In some instances, the controller 32 may be configured to monitor the measure of flow rate of the supply air flow 28 for possible drift over time by performing one or more of comparing a current measure of flow rate of the supply air flow 28 with an average of two or more previous measures of flow rate of the supply air flow 28, comparing a current measure of flow rate of the supply air flow 28 with a predetermined flow rate threshold, and comparing one or more changes in the measure of flow rate of the supply air flow 28 with one or more changes in a pressure in the supply air flow 28. In some instances, the controller 32 may be configured to monitor the measure of humidity of the supply air flow 28 for possible drift over time by, for example, comparing the measure of humidity of the supply air flow 28 with a measure of humidity of the mixed air flow 22.

In some instances, the controller 32 may be configured to monitor the measure of energy delivered by the heating and/or cooling unit 24 to the supply air flow 28 for possible drift over time by performing one or more of comparing a current measure of energy delivered by the heating and/or cooling unit 24 to the supply air flow 28 with a predetermined energy delivery baseline, comparing a performance of the heating and/or cooling unit 24 over time to detect a change in performance of the heating and/or cooling unit 24 over time, and comparing a temperature difference between an inlet temperature (of the inlet flow 30*a*) and an outlet temperature (of the outlet flow 30*b*) of the heating and/or cooling fluid flowing through the heating and/or cooling unit 24 with a predetermined expected temperature difference. When a drift is detected in any of the measure of flow rate of the supply air flow 28, the measure of humidity of the supply air flow 28, or the measure of energy delivered by the heating and/or cooling unit 24, an alarm is issued indicating that the AHU should be re-calibrated and/or serviced.

Figure 2A:
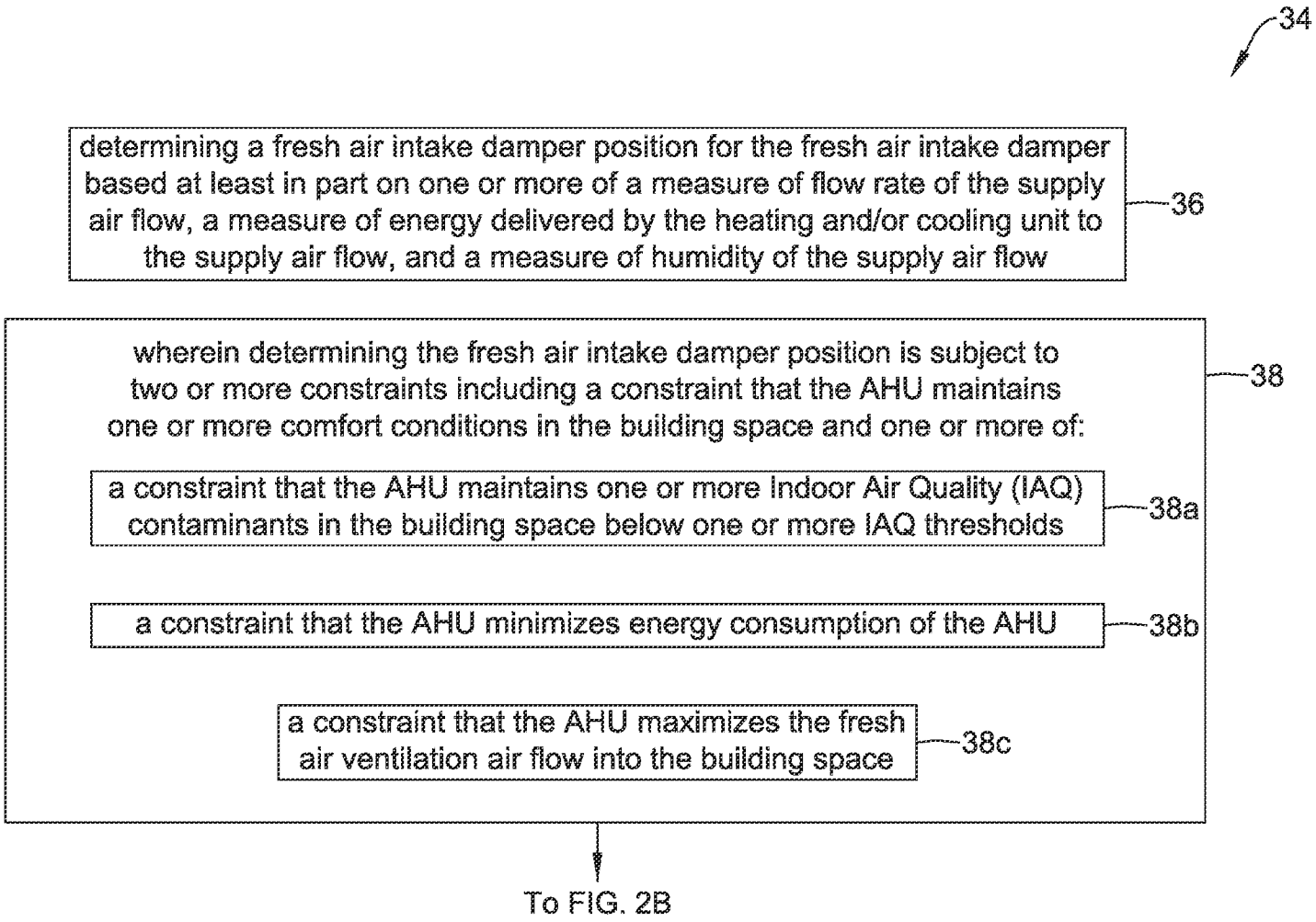
FIGS. 2A, 2B and 2C are flow diagrams that together show an illustrative method for controlling a fresh air intake of an AHU such as the AHU shown in FIG. 1.
Figure 2B:
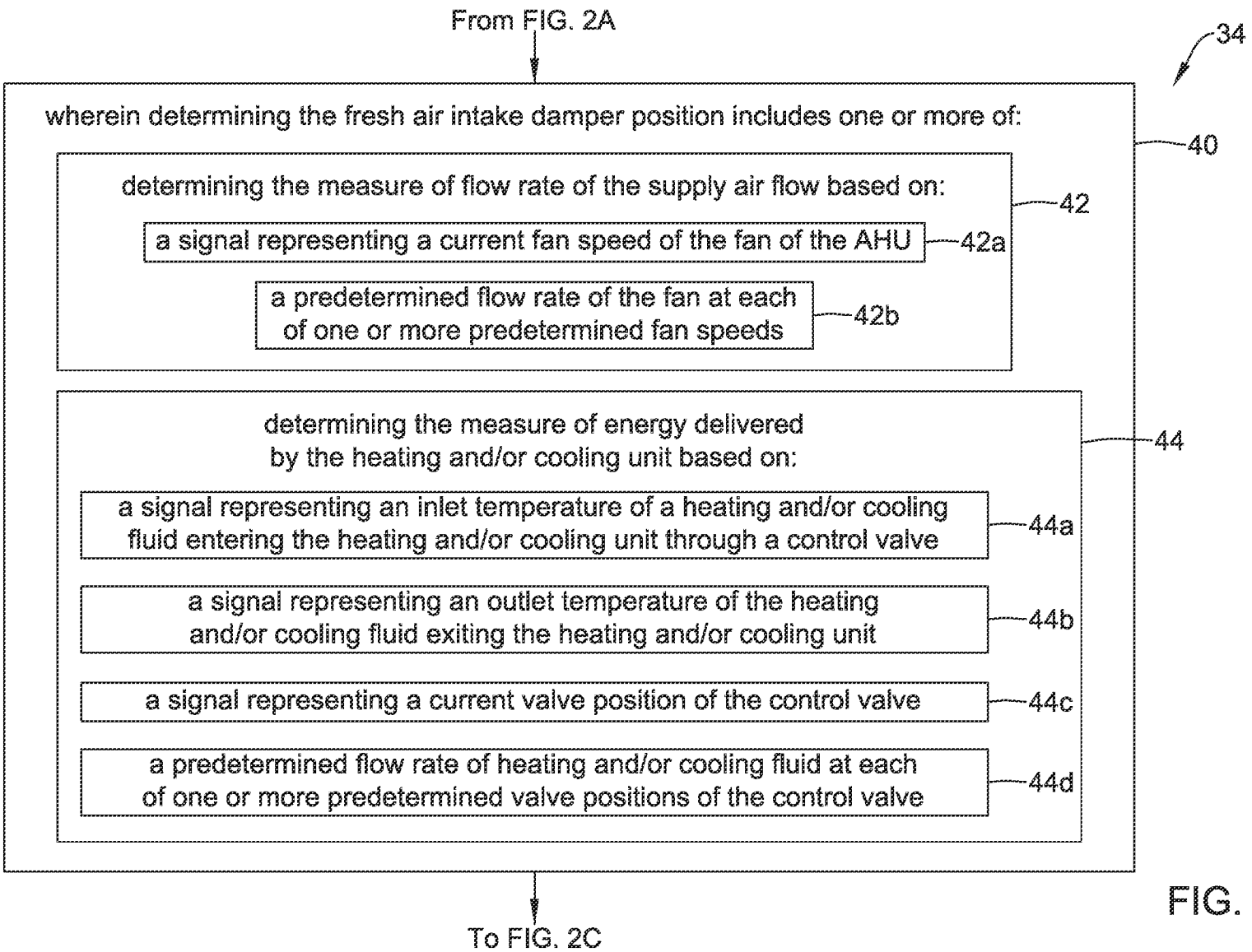
Figure 2C:
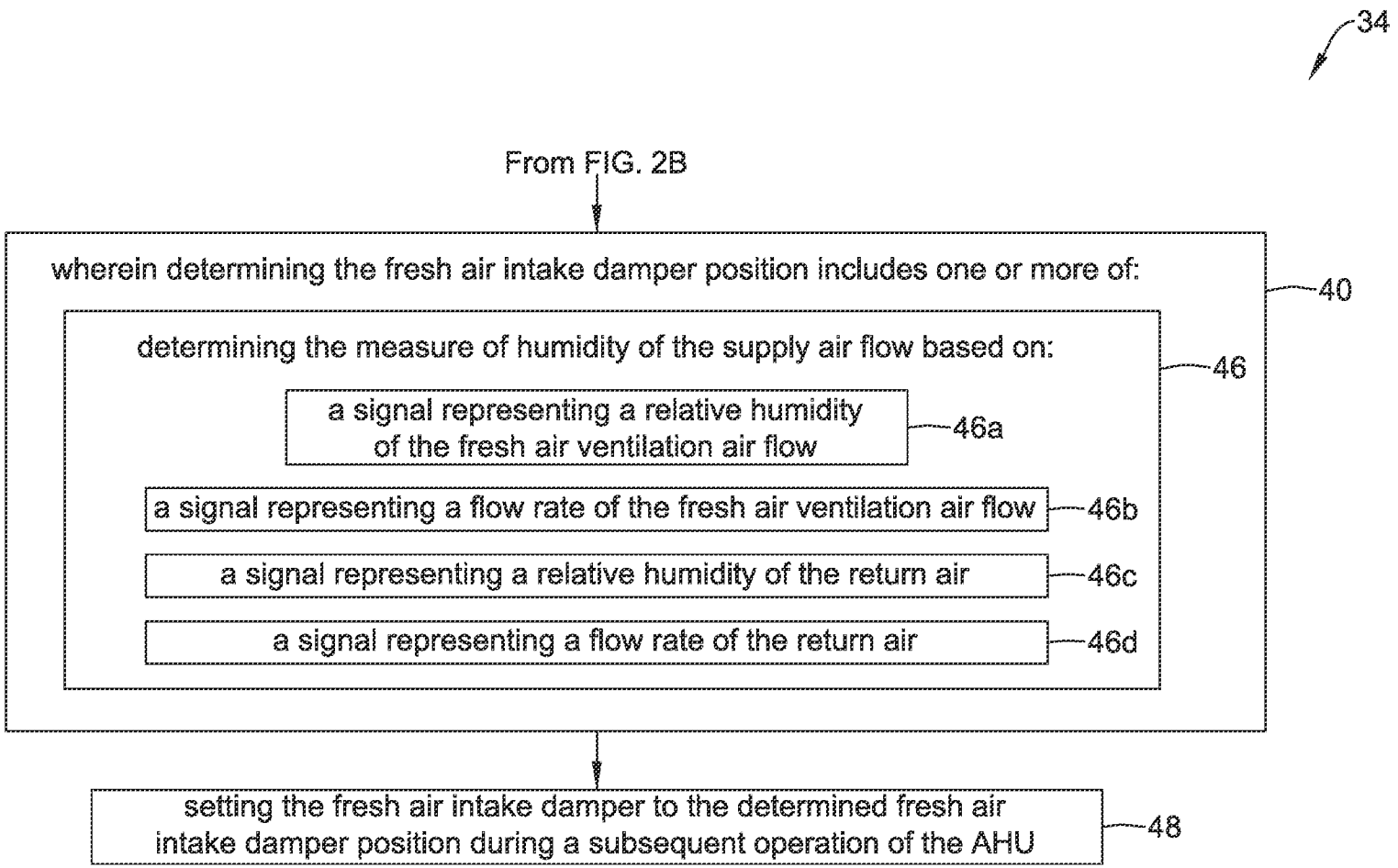

FIGS. 2A, 2B and 2C are flow diagrams that together show an illustrative method 34 for controlling a fresh air intake of an AHU (such as the AHU 10) of an HVAC system servicing a building space (such as the building space 12). The AHU includes a fresh air intake damper (such as the fresh air intake damper 14) for admitting a fresh air ventilation air flow, a return air duct (such as the return air duct 16) for receiving return air from the building space, a mixed air duct (such as the mixed air duct 18) for mixing the fresh air ventilation air flow from the fresh air intake damper and return air from the return air duct and providing a mixed air flow (such as the mixed air flow 22) to a heating and/or cooling unit (such as the heating and/or cooling unit 24) of the AHU which supplies a supply air flow to the building space. The AHU further includes a fan (such as the fan 26) for providing a motive force to move the return air, the fresh air ventilation air flow, the mixed air flow and the supply air flow through the AHU.

The illustrative method 34 includes determining a fresh air intake damper position for the fresh air intake damper based at least in part on one or more of a measure of flow rate of the supply air flow, a measure of energy delivered by the heating and/or cooling unit to the supply air flow, and a measure of humidity of the supply air flow, as indicated at block 36.

In some instances, determining the fresh air intake damper position is subject to two or more constraints including a constraint that the AHU maintains one or more comfort conditions in the building space, as indicated at block 38. The two or more constraints may further include one or more of a constraint that the AHU maintains one or more Indoor Air Quality (IAQ) contaminants in the building space below one or more IAQ thresholds, as indicted at block 38*a*, a constraint that the AHU minimizes energy consumption of the AHU, as indicated at block 38*b*, and a constraint that the AHU maximizes the fresh air ventilation air flow into the building space, as indicated at block 38*c*.

In some instances, and referring now to FIG. 2B, and as indicated at block 40, determining the fresh air intake damper position may include one or more processes. In some instances, determining the fresh air intake damper position may include determining the measure of flow rate of the supply air flow, as indicated at block 42. Determining the measure of flow rate of the supply air flow may include a signal representing a current fan speed of the fan of the AHU, as indicated at block 42*a*. Determining the measure of flow rate of the supply air flow may include a predetermined flow rate of the fan at each of one or more predetermined fan speeds, as indicated at block 42*b*. The predetermined flow rate of the fan at each of one or more predetermined fan speeds may be taken from a data sheet from the manufacturer of the fan and/or AHU, or may be measured during a characterization of the fan.

In some instances, determining the fresh air intake damper position may include determining the measure of energy delivered by the heating and/or cooling unit, as indicated at block 44. Determining the measure of energy delivered by the heating and/or cooling unit may be based on a signal representing an inlet temperature of a heating and/or cooling fluid entering the heating and/or cooling unit through a control valve, as indicated at block 44*a*. Determining the measure of energy delivered by the heating and/or cooling unit may be based on a signal representing an outlet temperature of the heating and/or cooling fluid exiting the heating and/or cooling unit, as indicated at block 44*b*. In some cases, the inlet temperature and the outlet temperature may be provided by temperature sensors of the heating and/or cooling unit. Determining the measure of energy delivered by the heating and/or cooling unit may be based on a signal representing a current valve position of the control valve, as indicated at block 44*c*. Determining the measure of energy delivered by the heating and/or cooling unit may be based on a predetermined flow rate of heating and/or cooling fluid at each of one or more predetermined valve positions of the control valve, as indicated at block 44*d*. The predetermined flow rate of the heating and/or cooling fluid at each of one or more predetermined valve positions of the control valve may be taken from a data sheet from the manufacturer of the AHU, or may be measured during a characterization of the AHU.

Continuing on FIG. 2C, determining the fresh air intake damper position may be based on determining the measure of the humidity of the supply air flow, as indicated at block 46. In some instances, determining the measure of humidity of the supply air flow may be based on a signal representing a relative humidity of the fresh air ventilation air flow, as indicated at block 46*a*. In some instances, determining the measure of humidity of the supply air flow may be based on a signal representing a flow rate of the fresh air ventilation air flow, as indicated at block 46*b*. In some instances, determining the measure of humidity of the supply air flow may be based on a signal representing a relative humidity of the return air, as indicated at block 46*c*. In some instances, determining the measure of humidity of the supply air flow may be based on a signal representing a flow rate of the return air, as indicated at block 46*d*.

The illustrative method 34 includes setting the fresh air intake damper to the determined fresh air intake damper position during a subsequent operation of the AHU, as indicated at block 48.

In some instances, determining the fresh air intake damper position may include determining the fresh air intake damper position based at least in part on two or more of the measure of flow rate of the supply air flow, the measure of energy delivered by the heating and/or cooling unit and the measure of humidity of the supply air flow. In some instances, determining the fresh air intake damper position may include determining the fresh air intake damper position based at least in part on the measure of flow rate of the supply air flow, the measure of energy delivered by the heating and/or cooling unit and the measure of humidity of the supply air flow. These are just examples.

In some instances, determining the fresh air intake damper position may include determining the measure of flow rate of the supply air flow based on the signal representing the current fan speed of the fan of the AHU and the predetermined flow rate of the fan at each of one or more predetermined fan speeds. As an example, the measure of flow rate of the supply air flow may be determined in accordance with the equation:

$$CFM = \frac{RPM}{\text{design } RPM} \times \text{design } CFM,$$

where:

CFM represents the flow rate of the supply air flow in Cubic Feet per Minute (CFM);

RPM represents the current fan speed of the fan of the AHU in Revolutions Per Minute (RPM);

design RPM represents one of the one or more the predetermined fan speeds of the fan (e.g. from a data sheet of the fan); and design CFM represents the predetermined flow rate at the one of the one or more predetermined fan speeds of the fan (design RPM) (e.g. from the data sheet of the fan).

In some instances, the flow rate of the supply air flow (CFM) is corrected in accordance with a correction factor given by the equation:

$$k = \frac{\text{Estimated } CFM}{\text{Actual } CFM},$$

where, the corrected flow rate of the supply air flow is expressed as the flow rate of the supply air flow divided by the correction factor $$k \text{ as} = \frac{CFM}{k}.$$

In some instances, determining the fresh air intake damper position may include determining the measure of energy delivered by the heating and/or cooling unit based on the signal representing the inlet temperature of the heating and/or cooling fluid entering the heating and/or cooling unit, the signal representing an outlet temperature of the heating and/or cooling fluid exiting the heating and/or cooling unit, the signal representing the current valve position of the control valve, and the predetermined flow rate of heating and/or cooling fluid at each of one or more predetermined valve positions of the control valve. As an example, the measure of energy may be determined in accordance with the equation:

$$Q = mc\Delta T$$

where:

Q represents the measure of energy delivered by the heating and/or cooling unit;

m represents the mass flow rate of the heating and/or cooling fluid flowing through the heating and/or cooling unit;

c represents the specific heat capacity of the heating and/or cooling fluid; and ΔT represents a temperature difference between the inlet temperature and the outlet temperature of the heating and/or cooling fluid.

In some instances, determining the fresh air intake damper position may include determining the measure of humidity of the supply air flow based on the signal representing the relative humidity of the fresh air ventilation air flow, the signal representing the flow rate of the fresh air ventilation air flow, the signal representing the relative humidity of the return air, and the signal representing the flow rate of the return air. As an example, the measure of humidity may be determined in accordance with the equation:

$$\text{Mixed air } rH: \left(OA\,rH * \frac{OA \text{ flow rate}}{OA \text{ flow rate} + RA \text{ flow rate}}\right) + \left(RA\,rH * \frac{RA \text{ flow rate}}{OA \text{ flow rate} + RA \text{ flow rate}}\right),$$

where:

Mixed air rH represents a measure of relative humidity of the mixed air flow;

OA rH represents the relative humidity of the fresh air ventilation air flow;

OA flow rate represents the flow rate of the fresh air ventilation air flow;

RA rH represents the relative humidity of the return air;

RA flow rate represents the flow rate of the return air; and setting the measure of humidity of the supply air flow equal to the measure of relative humidity of the mixed air flow (Mixed air rH).

In some instances, determining the fresh air intake damper position may include two or more of determining the measure of flow rate of the supply air flow, determining the measure of energy delivered by the heating and/or cooling unit and determining the measure of humidity of the supply air. In some instances, determining the fresh air intake damper position includes determining the measure of flow rate of the supply air flow based on all three of determining the measure of energy delivered by the heating and/or cooling unit, and determining the measure of humidity of the supply air flow.

Figure 3A:
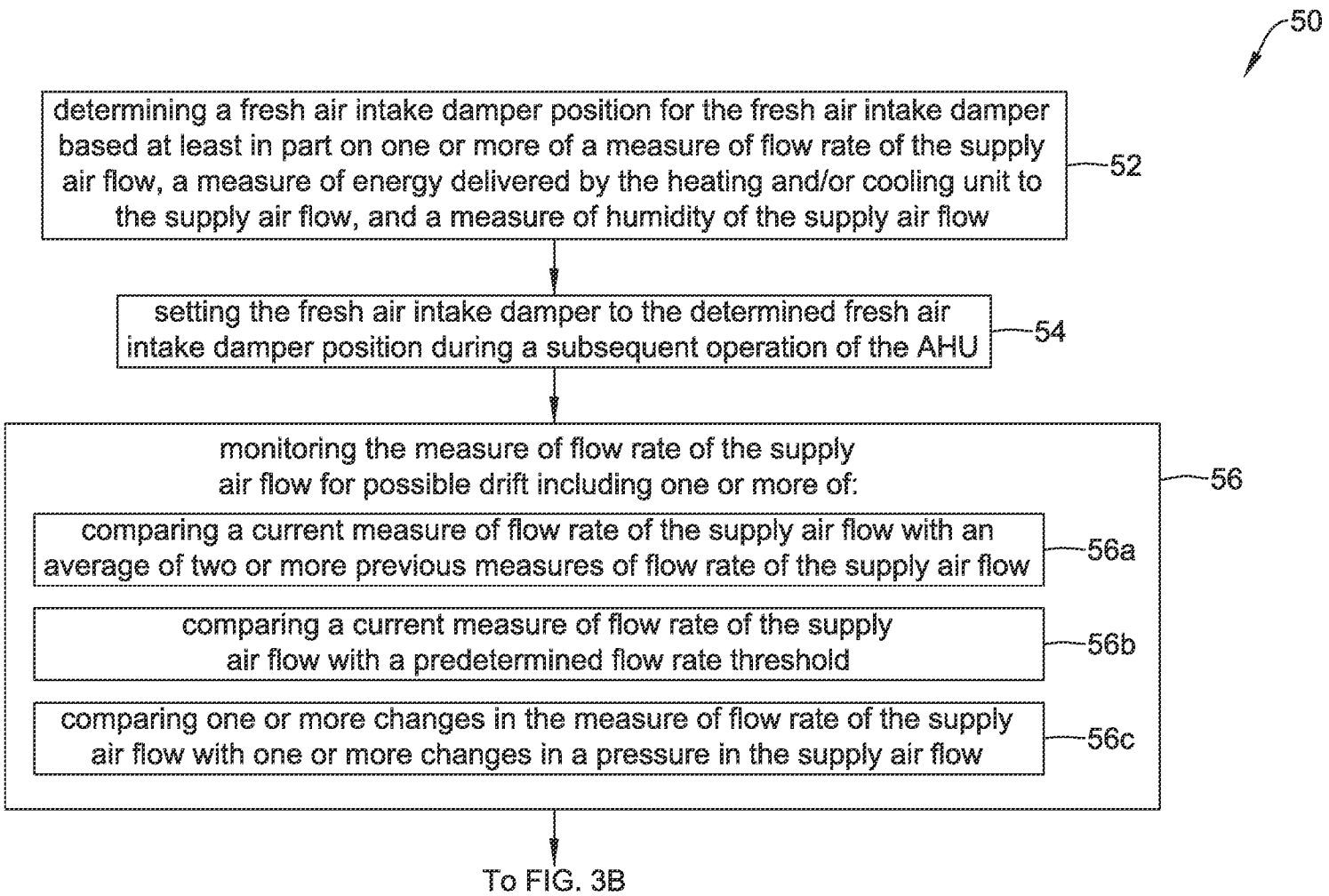
FIGS. 3A and 3B are flow diagrams that together show an illustrative method for controlling a fresh air intake of an AHU such as the AHU shown in FIG. 1.
Figure 3B:
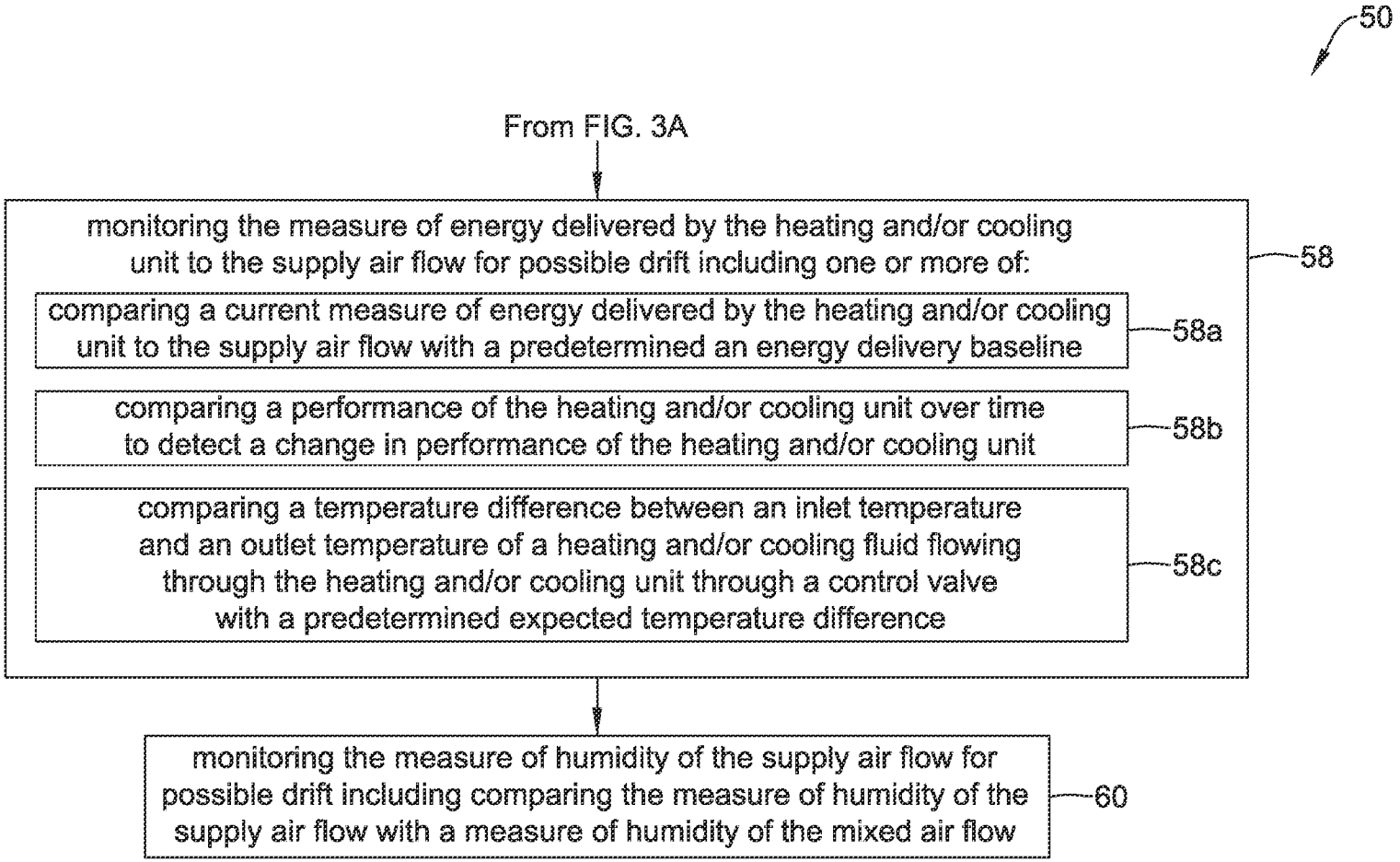

FIGS. 3A and 3B are flow diagrams that together show an illustrative method 50 for controlling a fresh air intake of an AHU (such as the AHU 10) of an HVAC system servicing a building space (such as the building space 12). The AHU including a fresh air intake damper (such as the fresh air intake damper 14) for admitting a fresh air ventilation air flow, a return air duct (such as the return air duct 16) for receiving return air from the building space, a mixed air duct (such as the mixed air duct 18) for mixing the fresh air ventilation air flow from the fresh air intake damper and return air from the return air duct and providing a mixed air flow (such as the mixed air flow 22) to a heating and/or cooling unit (such as the heating and/or cooling unit 24) of the AHU which supplies a supply air flow to the building space, the AHU including a fan (such as the fan 26) for providing a motive force to move the return air, the fresh air ventilation air flow, the mixed air flow and the supply air flow through the AHU.

The illustrative method 50 includes determining a fresh air intake damper position for the fresh air intake damper based at least in part on one or more of a measure of flow rate of the supply air flow, a measure of energy delivered by the heating and/or cooling unit to the supply air flow, and a measure of humidity of the supply air flow, as indicated at block 52. The illustrative method 50 includes setting the fresh air intake damper to the determined fresh air intake damper position during a subsequent operation of the AHU, as indicated at block 54.

In some instances, the method 50 may further include monitoring the measure of flow rate of the supply air flow for possible drift, as indicated at block 56. Monitoring the measure of flow rate of the supply air flow for possible drift may include comparing a current measure of flow rate of the supply air flow with an average of two or more previous measures of flow rate of the supply air flow, as indicated at block 56*a*. Monitoring the measure of flow rate of the supply air flow for possible drift may include comparing a current measure of flow rate of the supply air flow with a predetermined flow rate threshold, as indicated at block 56*b*. Monitoring the measure of flow rate of the supply air flow for possible drift may include comparing one or more changes in the measure of flow rate of the supply air flow with one or more changes in a pressure (e.g. duct pressure) in the supply air flow, as indicated at block 56*c*.

Continuing on FIG. 3B, the illustrative method 50 may further include monitoring the measure of energy delivered by the heating and/or cooling unit to the supply air flow for possible drift, as indicated at block 58. Monitoring the measure of energy delivered by the heating and/or cooling unit to the supply air flow for possible drift may include comparing a current measure of energy delivered by the heating and/or cooling unit to the supply air flow with a predetermined an energy delivery baseline, as indicated at block 58*a*. For example, an energy baseline for the AHU may be established using features such as outside temp, cooling degree days, heating degree days, occupancy and humidity. This can be used to compute expected energy consumption. If for a long duration, the calculated energy is higher than the observed energy, such as more than 2 standard deviations from baseline, for a long duration (such as a week), then drift is indicated (assuming flow and pressure hasn't changed drastically)

Monitoring the measure of energy delivered by the heating and/or cooling unit to the supply air flow for possible drift may include comparing a performance of the heating and/or cooling unit over time to detect a change in performance of the heating and/or cooling unit, as indicated at block 58*b*. For example, if the heating and/or cooling flow changes over time to achieve the same or similar temperature drops across the inlet and outlet of the heating and/or cooling unit under similar conditions (e.g. similar mixed air temperature), a drift is indicated in the performance of the heating and/or cooling unit.

Monitoring the measure of energy delivered by the heating and/or cooling unit to the supply air flow for possible drift may include comparing a temperature difference between an inlet temperature and an outlet temperature of a heating and/or cooling fluid flowing through the heating and/or cooling unit through a control valve with a predetermined expected temperature difference under similar conditions (e.g. similar mixed air temperature and flow), as indicated at block 58*c*. The predetermined expected temperature difference versus flow rate of the heating and/or cooling fluid over certain conditions (e.g. mixed air temperature and flow) may be derived from a data sheet of the manufacturer of the AHU, or may be measured during a characterization of the AHU. In some instances, the method 50 may further include monitoring the measure of humidity of the supply air flow for possible drift includes, for example, comparing the measure of humidity of the supply air flow with a measure of humidity of the mixed air flow, as indicated at block 60. If these values start to diverge over time, drift may be indicated in the measure of humidity of the supply air flow.

Figure 4:
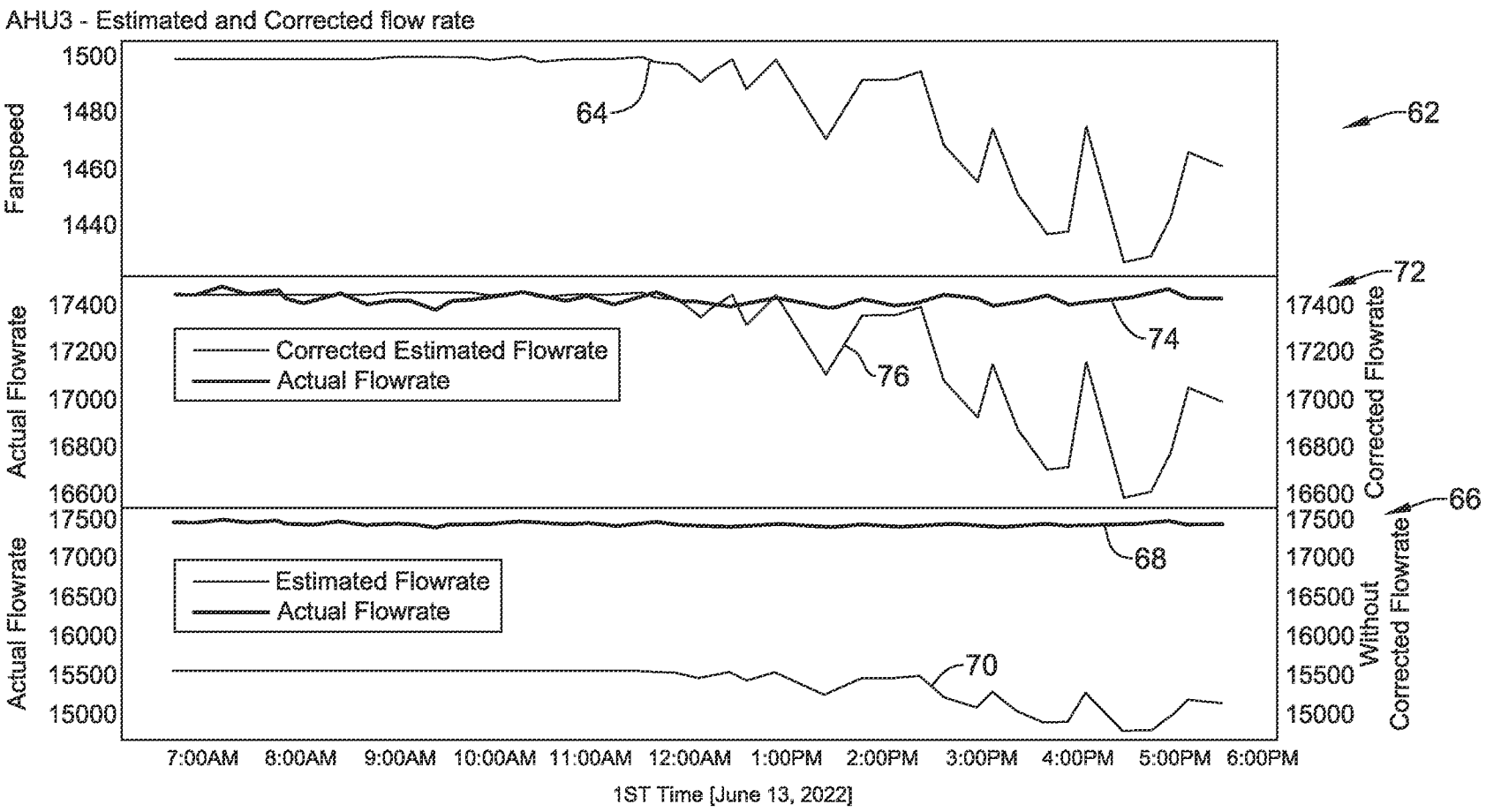
FIG. 4 is a graph providing comparisons between estimated and actual flow rates through an AHU such as the AHU of FIG. 1.

FIG. 4 is a graph providing comparisons between estimated and actual flow rates of supply air. FIG. 4 includes a first graph 62 including a data line 64 that shows fan speed over time. As can be seen, the fan speed was fairly constant from 7 am to about 12 noon for the day shown, and varied considerably during the afternoon for the day shown. FIG. 4 includes a second graph 66 including a data line 68 showing actual flow rate and a data line 70 showing estimated flow rate. It will be appreciated that the estimated flow rate 70 is not very close to the actual flow rate 78, without any correction factor. FIG. 4 includes a third graph 72 including a data line 74 showing actual flow rate and a data line 76 showing the estimated flow rate with a correction factor. It will be appreciated that in the morning of the day shown, the estimated flow rate 76 is quite close to the actual flow rate 74. This demonstrates that flow rate can be reasonably estimated in the absence of an air flow sensor (e.g. based on fan speed). Significant changes in the afternoon fan speed seem to have impacted accuracy in the afternoon.

Figure 5:
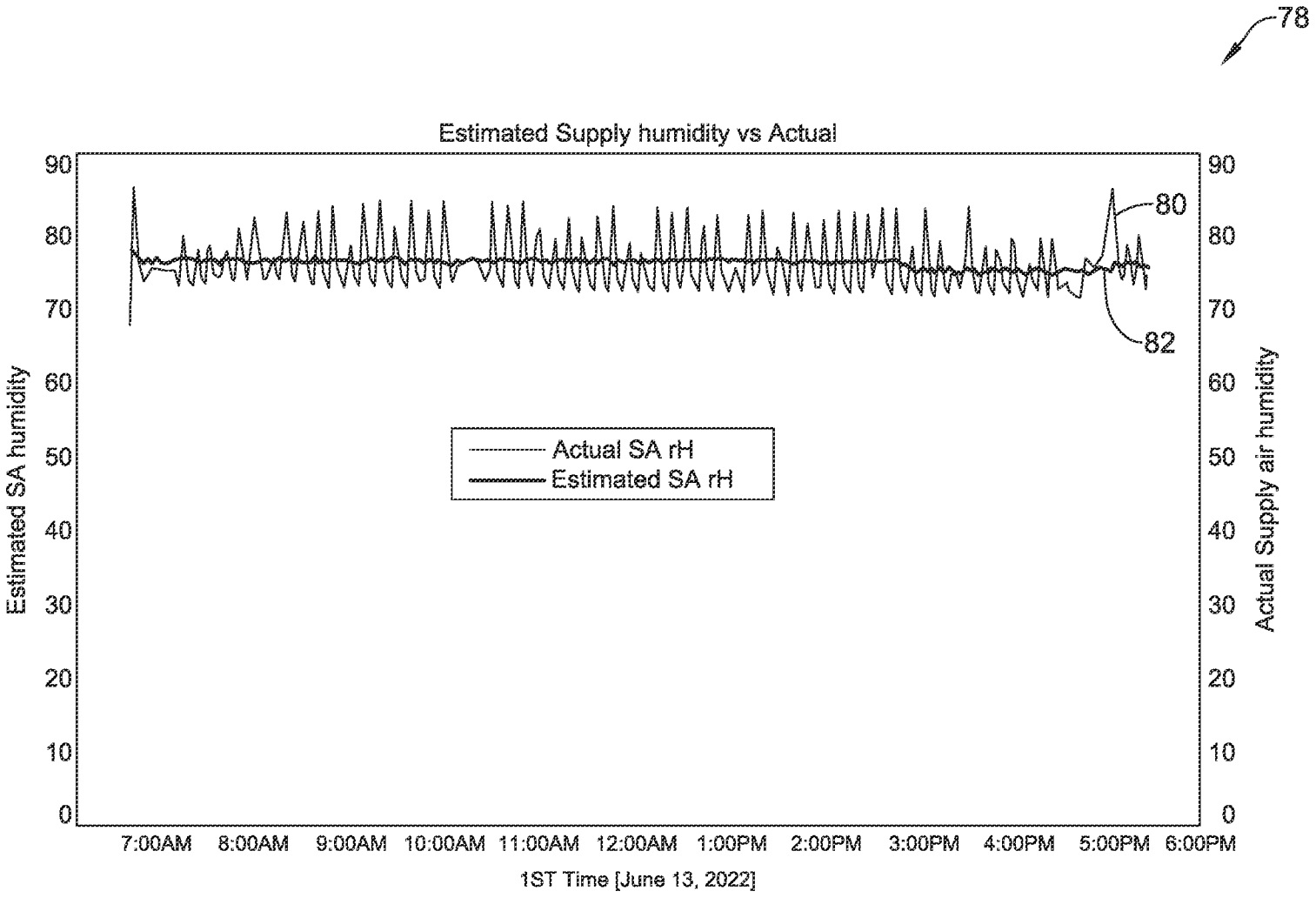
FIG. 5 is a graph providing comparisons between estimated and actual supply air humidity.

FIG. 5 is a graph providing comparisons between estimated and actual supply air humidity. FIG. 5 includes a graph 78 including a first data line 80 showing actual supply air relative humidity and a second data line 82 showing estimated supply air relative humidity. While the actual supply air relative humidity varied more than the estimated supply air relative humidity, it will be appreciated that the estimated supply air relative humidity is reasonably close to an average of the actual supply air relative humidity. This demonstrates that supply air humidity can be reasonably estimated in the absence of a supply air relative humidity sensor.

Having thus described several illustrative embodiments of the present disclosure, those of skill in the art will readily appreciate that yet other embodiments may be made and used within the scope of the claims hereto attached. It will be understood, however, that this disclosure is, in many respects, only illustrative. Changes may be made in details, particularly in matters of shape, size, arrangement of parts, and exclusion and order of steps, without exceeding the scope of the disclosure. The disclosure's scope is, of course, defined in the language in which the appended claims are expressed.

What is claimed is:

1. A method for controlling a fresh air intake of an Air Handling Unit (AHU) of an HVAC (Heating, Ventilating and Air Conditioning) system servicing a building space, the AHU including a fresh air intake damper for admitting a fresh air ventilation air flow, a return air duct for receiving return air from the building space, a mixed air duct for mixing the fresh air ventilation air flow from the fresh air intake damper and return air from the return air duct and providing a mixed air flow to a heating and/or cooling unit of the AHU which supplies a supply air flow to the building space, the AHU including a fan for providing a motive force to move the return air, the fresh air ventilation air flow, the mixed air flow and the supply air flow through the AHU, the method comprising:

determining a fresh air intake damper position for the fresh air intake damper based at least in part on each of a measure of flow rate of the supply air flow, a measure of energy delivered by the heating and/or cooling unit to the supply air flow, and a measure of humidity of the supply air flow;

wherein determining the fresh air intake damper position is subject to two or more constraints including a constraint that the AHU maintains one or more comfort conditions in the building space and one or more of:

a constraint that the AHU maintains one or more Indoor Air Quality (IAQ) contaminants in the building space below one or more IAQ thresholds;

a constraint that the AHU minimizes energy consumption of the AHU; and a constraint that the AHU maximizes the fresh air ventilation air flow into the building space;

wherein determining the fresh air intake damper position includes one or more of:

determining the measure of flow rate of the supply air flow based on:

a signal representing a current fan speed of the fan of the AHU; and a predetermined flow rate of the fan at each of one or more predetermined fan speeds;

determining the measure of humidity of the supply air flow based on:

a signal representing a relative humidity of the fresh air ventilation air flow;

a signal representing a flow rate of the fresh air ventilation air flow;

a signal representing a relative humidity of the return air; and a signal representing a flow rate of the return air;

setting the fresh air intake damper to the determined fresh air intake damper position during a subsequent operation of the AHU.

2. The method of claim 1, wherein determining the fresh air intake damper position includes:

determining the measure of flow rate of the supply air flow based on:

the signal representing the current fan speed of the fan of the AHU; and the predetermined flow rate of the fan at each of one or more predetermined fan speeds.

3. The method of claim 2, wherein the measure of flow rate of the supply air flow is determined in accordance with the equation:

$$CFM = \frac{RPM}{\text{design } RPM} \times \text{design } CFM,$$

where:

CFM represents the flow rate of the supply air flow in Cubic Feet per Minute (CFM);

RPM represents the current fan speed of the fan of the AHU in Revolutions Per Minute (RPM);

design RPM represents one of the one or more the predetermined fan speeds of the fan; and design CFM represents the predetermined flow rate at the one of the one or more predetermined fan speeds of the fan (design RPM).

4. The method of claim 3, wherein the flow rate of the supply air flow (CFM) is corrected in accordance with a correction factor given by the equation:

$$k = \frac{\text{Estimated } CFM}{\text{Actual } CFM},$$

and where, the corrected flow rate of the supply air flow is expressed as the flow rate of the supply air flow divided by the correction factor $$K\text{ as} = \frac{CFM}{k}.$$

5. The method of claim 1, wherein the measure of energy is determined in accordance with the equation:

$$Q=mc\Delta T$$

where:

Q represents the measure of energy delivered by the heating and/or cooling unit;

m represents the mass flow rate of the heating and/or cooling fluid flowing through the heating and/or cooling unit;

c represents the specific heat capacity of the heating and/or cooling fluid; and ΔT represents a temperature difference between the inlet temperature and the outlet temperature of the heating and/or cooling fluid.

6. The method of claim 1, wherein determining the fresh air intake damper position includes:

determining the measure of humidity of the supply air flow based on:

the signal representing the relative humidity of the fresh air ventilation air flow;

the signal representing the flow rate of the fresh air ventilation air flow;

the signal representing the relative humidity of the return air; and the signal representing the flow rate of the return air.

7. The method of claim 6, wherein the measure of humidity is determined in accordance with the equation:

$$\text{Mixed air } rH: \left(OA\,rH * \frac{OA \text{ flow rate}}{OA \text{ flow rate} + RA \text{ flow rate}}\right) + \left(RA\,rH * \frac{RA \text{ flow rate}}{OA \text{ flow rate} + RA \text{ flow rate}}\right),$$

where:

Mixed air rH represents a measure of relative humidity of the mixed air flow;

OA rH represents the relative humidity of the fresh air ventilation air flow;

OA flow rate represents the flow rate of the fresh air ventilation air flow;

RA rH represents the relative humidity of the return air;

RA flow rate represents the flow rate of the return air; and setting the measure of humidity of the supply air flow equal to the measure of relative humidity of the mixed air flow (Mixed air rH).

8. The method of claim 1, wherein determining the fresh air intake damper position includes at least one of:

determining the measure of flow rate of the supply air flow based on:

the signal representing the current fan speed of the fan of the AHU; and the predetermined flow rate of the fan at each of one or more predetermined fan speeds;

determining the measure of humidity of the supply air flow based on:

the signal representing the relative humidity of the fresh air ventilation air flow;

the signal representing the flow rate of the fresh air ventilation air flow;

the signal representing the relative humidity of the return air; and the signal representing the flow rate of the return air.

9. The method of claim 1, wherein determining the fresh air intake damper position includes:

determining the measure of flow rate of the supply air flow based on:

the signal representing the current fan speed of the fan of the AHU; and the predetermined flow rate of the fan at each of one or more predetermined fan speeds;

determining the measure of humidity of the supply air flow based on:

the signal representing the relative humidity of the fresh air ventilation air flow;

the signal representing the flow rate of the fresh air ventilation air flow;

the signal representing the relative humidity of the return air; and the signal representing the flow rate of the return air.

10. The method of claim 1, further comprising monitoring the measure of flow rate of the supply air flow for possible drift including one or more of:

comparing a current measure of flow rate of the supply air flow with an average of two or more previous measures of flow rate of the supply air flow;

comparing a current measure of flow rate of the supply air flow with a predetermined flow rate threshold; and comparing one or more changes in the measure of flow rate of the supply air flow with one or more changes in a pressure in the supply air flow.

11. The method of claim 1, further comprising monitoring the measure of energy delivered by the heating and/or cooling unit to the supply air flow for possible drift including one or more of:

comparing a current measure of energy delivered by the heating and/or cooling unit to the supply air flow with a predetermined an energy delivery baseline;

comparing a performance of the heating and/or cooling unit over time to detect a change in performance of the heating and/or cooling unit; and comparing a temperature difference between an inlet temperature and an outlet temperature of a heating and/or cooling fluid flowing through the heating and/or cooling unit through a control valve with a predetermined expected temperature difference.

12. The method of claim 1, further comprising monitoring the measure of humidity of the supply air flow for possible drift including comparing the measure of humidity of the supply air flow with a measure of humidity of the mixed air flow.

13. An Air Handling Unit (AHU) of an HVAC (Heating, Ventilating and Air Conditioning) system for servicing a building space, the AHU including:

a fresh air intake damper for admitting a fresh air ventilation air flow;

a return air duct for receiving return air from the building space;

a heating and/or cooling unit;

a mixed air duct for mixing the fresh air ventilation air flow from the fresh air intake damper and return air from the return air duct and providing a mixed air flow to the heating and/or cooling unit of the AHU which supplies a supply air flow to the building space;

a fan for providing a motive force to move the return air, the fresh air ventilation air flow, the mixed air flow and the supply air flow through the AHU;

a controller operatively coupled to the fresh air intake damper, the heating and/or cooling unit and the fan, the controller configured to:

determine a fresh air intake damper position for the fresh air intake damper based at least in part on each of a measure of flow rate of the supply air flow, a measure of energy delivered by the heating and/or cooling unit to the supply air flow, and a measure of humidity of the supply air flow;

wherein the fresh air intake damper position is subject to two or more constraints including a constraint that the AHU maintains one or more comfort conditions in the building space and of:

a constraint that the AHU maintains one or more Indoor Air Quality (IAQ) contaminants in the building space below one or more IAQ thresholds;

a constraint that the AHU minimizes energy consumption of the AHU; and a constraint that the AHU maximizes the fresh air ventilation air flow into the building space;

wherein the controller, when determining the fresh air intake damper position, includes of:

determine the measure of flow rate of the supply air flow based on:

a signal representing a current fan speed of the fan of the AHU; and a predetermined flow rate of the fan at each of one or more predetermined fan speeds;

determine the measure of humidity of the supply air flow based on:

a signal representing a relative humidity of the fresh air ventilation air flow;

a signal representing a flow rate of the fresh air ventilation air flow;

a signal representing a relative humidity of the return air;

a signal representing a flow rate of the return air; and set the fresh air intake damper to the determined fresh air intake damper position.

14. The system of claim 13, wherein the controller is configured to determine the measure of flow rate of the supply air flow based on:

the signal representing the current fan speed of the fan of the AHU;

the predetermined flow rate of the fan at each of one or more predetermined fan speeds;

wherein the measure of flow rate of the supply air flow is determined in accordance with the equation:

$$CFM = \frac{RPM}{\text{design } RPM} \times \text{design } CFM,$$

where:

CFM represents the flow rate of the supply air flow in Cubic Feet per Minute (CFM);

RPM represents the current fan speed of the fan of the AHU in Revolutions Per Minute (RPM);

design RPM represents one of the one or more predetermined fan speeds of the fan; and design CFM represents the predetermined flow rate at the one of the one or more predetermined fan speeds of the fan (design RPM).

15. The system of claim 13, wherein the measure of energy is determined in accordance with the equation:

$$Q=mc\Delta T$$

where:

Q represents the measure of energy delivered by the heating and/or cooling unit;

m represents the mass flow rate of the heating and/or cooling fluid flowing through the heating and/or cooling unit;

c represents the specific heat capacity of the heating and/or cooling fluid; and ΔT represents a temperature difference between the inlet temperature and the outlet temperature of the heating and/or cooling fluid.

16. The system of claim 13, wherein the controller is configured to determine the measure of humidity of the supply air flow based on:

the signal representing the relative humidity of the fresh air ventilation air flow;

the signal representing the flow rate of the fresh air ventilation air flow;

the signal representing the relative humidity of the return air;

the signal representing the flow rate of the return air;

wherein the measure of humidity is determined in accordance with the equation:

$$\text{Mixed air } rH: \left(OA\,rH * \frac{OA \text{ flow rate}}{OA \text{ flow rate} + RA \text{ flow rate}}\right) + \left(RA\,rH * \frac{RA \text{ flow rate}}{OA \text{ flow rate} + RA \text{ flow rate}}\right),$$

where:

Mixed air rH represents a measure of relative humidity of the mixed air flow;

OA rH represents the relative humidity of the fresh air ventilation air flow;

OA flow rate represents the flow rate of the fresh air ventilation air flow;

RA rH represents the relative humidity of the return air; and

RA flow rate represents the flow rate of the return air; and setting the measure of humidity of the supply air flow equal to the measure of relative humidity of the mixed air flow (Mixed air rH).

17. A non-transitory computer readable medium storing instructions thereon that when executed by one or more processors cause the one or more processors to:

control a fresh air intake damper of an Air Handling Unit (AHU) of an HVAC (Heating, Ventilating and Air Conditioning) system servicing a building space, wherein the AHU includes:

a fresh air intake damper for admitting a fresh air ventilation air flow;

a return air duct for receiving return air from the building space;

a heating and/or cooling unit;

a mixed air duct for mixing the fresh air ventilation air flow from the fresh air intake damper and return air from the return air duct and providing a mixed air flow to the heating and/or cooling unit of the AHU which supplies a supply air flow to the building space;

a fan for providing a motive force to move the return air, the fresh air ventilation air flow, the mixed air flow and the supply air flow through the AHU;

wherein the instructions cause the one or more processors to:

determine a fresh air intake damper position for the fresh air intake damper based at least in part on each of a measure of flow rate of the supply air flow, a measure of energy delivered by the heating and/or cooling unit to the supply air flow, and a measure of humidity of the supply air flow;

wherein the fresh air intake damper position is subject to two or more constraints including a constraint that the AHU maintains one or more comfort conditions in the building space and of:

a constraint that the AHU maintains one or more Indoor Air Quality (IAQ) contaminants in the building space below one or more IAQ thresholds;

a constraint that the AHU minimizes energy consumption of the AHU; and a constraint that the AHU maximizes the fresh air ventilation air flow into the building space;

wherein, when determining the fresh air intake damper position, the instructions cause the one or more processor to perform of:

determine the measure of flow rate of the supply air flow based on:

a signal representing a current fan speed of the fan of the AHU; and a predetermined flow rate of the fan at each of one or more predetermined fan speeds;

determine the measure of humidity of the supply air flow based on:

a signal representing a relative humidity of the fresh air ventilation air flow;

a signal representing a flow rate of the fresh air ventilation air flow;

a signal representing a relative humidity of the return air;

a signal representing a flow rate of the return air; and set the fresh air intake damper to the determined fresh air intake damper position.

18. The non-transitory computer readable medium of claim 17, wherein the measure of flow rate of the supply air flow is determined in accordance with the equation:

$$CFM = \frac{RPM}{\text{design } RPM} \times \text{design } CFM,$$

where:

CFM represents the flow rate of the supply air flow in Cubic Feet per Minute (CFM);

RPM represents the current fan speed of the fan of the AHU in Revolutions Per Minute (RPM);

design RPM represents one of the one or more the predetermined fan speeds of the fan; and design CFM represents the predetermined flow rate at the one of the one or more predetermined fan speeds of the fan (design RPM).

19. The non-transitory computer readable medium of claim 17, wherein the measure of energy is determined in accordance with the equation:

$$Q=mc\Delta T$$

where:

Q represents the measure of energy delivered by the heating and/or cooling unit;

m represents the mass flow rate of the heating and/or cooling fluid flowing through the heating and/or cooling unit;

c represents the specific heat capacity of the heating and/or cooling fluid; and $\Delta T$ represents a temperature difference between the inlet temperature and the outlet temperature of the heating and/or cooling fluid.

20. The non-transitory computer readable medium of claim 17, wherein determining the fresh air intake damper position includes:

determining the measure of humidity of the supply air flow based on:

the signal representing the relative humidity of the fresh air ventilation air flow;

the signal representing the flow rate of the fresh air ventilation air flow;

the signal representing the relative humidity of the return air; and the signal representing the flow rate of the return air.

* * * * *